US011821197B2

(12) United States Patent
Kerner

(10) Patent No.: US 11,821,197 B2
(45) Date of Patent: Nov. 21, 2023

(54) BUILDING COMPLEX COMPRISING AT LEAST TWO BUILDINGS, AND BUILDINGS

(71) Applicant: Franz Kerner, Stuttgart (DE)

(72) Inventor: Franz Kerner, Stuttgart (DE)

( * ) Notice: Subject to any disclaimer, the term of this patent is extended or adjusted under 35 U.S.C. 154(b) by 0 days.

(21) Appl. No.: 17/174,362

(22) Filed: Feb. 12, 2021

(65) Prior Publication Data

US 2021/0254328 A1 Aug. 19, 2021

(30) Foreign Application Priority Data

Feb. 14, 2020 (DE) ..... 10 2020 001 012.1

(51) Int. Cl.
*E04B 1/348* (2006.01)
*E04B 1/00* (2006.01)

(52) U.S. Cl.
CPC .. *E04B 1/34815* (2013.01); *E04B 2001/0053* (2013.01)

(58) Field of Classification Search
CPC ..... E04B 1/34815; E04B 2001/0053
USPC ..... 52/79.4
See application file for complete search history.

(56) References Cited

U.S. PATENT DOCUMENTS

D206,869 S * 2/1967 Hoke ..... E04B 1/2403 D25/5
3,600,865 A * 8/1971 Vanich ..... E04B 1/3404 D25/4
D222,343 S * 10/1971 Mullen ..... E04B 1/3404 D25/4
3,646,718 A * 3/1972 McKenna ..... E04B 1/34815 D25/19
3,712,007 A * 1/1973 Kump ..... E04B 1/2403 52/79.12
3,835,602 A * 9/1974 Tuuri ..... E04B 1/34321 52/200
3,861,093 A * 1/1975 Robinson ..... E04B 1/34853 52/79.14
3,905,167 A * 9/1975 Watkins ..... B32B 27/12 D25/4
3,956,860 A * 5/1976 Andrews ..... B65D 90/024 52/299
4,492,723 A * 1/1985 Chadwick, II ..... A63H 33/16 446/87
4,656,799 A * 4/1987 Maryon ..... E04H 1/06 52/30
4,663,897 A * 5/1987 Ridett ..... E04B 1/3404 126/628

(Continued)

FOREIGN PATENT DOCUMENTS

DE 2019392 A1 * 3/1972 ..... E04B 1/34815
DE 10023878 A1 * 3/2001 ..... E04H 1/04
WO WO-0034593 A1 * 6/2000 ..... E04B 1/34823

*Primary Examiner* — Brian D Mattei
*Assistant Examiner* — Joseph J. Sadlon
(74) *Attorney, Agent, or Firm* — Gudrun E. Huckett

(57) ABSTRACT

In building complexes of at least two buildings, the buildings each have a basic size in width direction and in length direction. The length and width of the building correspond to the basic size or to a multiple of this basic size. In buildings with at least two stories, in particular in a building complex, the building has at its bottom side at least one support that supports the building with formation of a venting space between the ground and the building bottom side. The venting space is part of an air circulation flowing about the building.

5 Claims, 28 Drawing Sheets

(56) References Cited

U.S. PATENT DOCUMENTS 4,723,381 A * 2/1988 Straumsnes ..... E04B 1/34807 52/79.12
D304,081 S * 10/1989 Vero ..... D25/5
4,881,351 A * 11/1989 Hamm ..... E04F 11/112 52/182
5,199,231 A * 4/1993 Dever ..... E04H 1/04 52/187
5,377,465 A * 1/1995 Kobori ..... E04B 1/3404 52/236.3
5,448,868 A * 9/1995 Lalvani ..... A63B 9/00 52/648.1
5,528,866 A * 6/1996 Yulkowski ..... E04B 1/3483 52/79.12
5,623,790 A * 4/1997 Lalvani ..... A63H 33/04 52/81.2
5,651,219 A * 7/1997 Baloga ..... A47B 83/001 52/36.1
5,931,420 A * 8/1999 Yamato ..... B64G 1/645 244/159.5
6,173,538 B1 * 1/2001 Fleishman ..... E04B 1/34815 52/81.3
6,802,160 B2 * 10/2004 Harambasic ..... E04B 1/04 446/124
8,286,392 B2 * 10/2012 Noble ..... E04B 1/3211 52/652.1
8,650,821 B2 * 2/2014 Ely, Jr. ..... E04B 1/19 52/236.3
D729,406 S * 5/2015 Brody ..... B65D 90/08 D25/5
9,222,249 B2 * 12/2015 Boardman ..... E04B 1/00
9,702,138 B1 * 7/2017 Rutherford ..... E04B 1/34853
9,890,554 B2 * 2/2018 Duncan, III ..... A47C 17/84
9,970,208 B2 * 5/2018 Irons ..... E04B 1/32
10,000,924 B2 * 6/2018 Lasry ..... B65D 90/08
10,100,510 B1 * 10/2018 Al Doukhi ..... E04H 15/56
10,183,608 B2 * 1/2019 Knight ..... B60P 3/341
10,526,781 B2 * 1/2020 Lestini ..... E04B 1/1912
2005/0138867 A1 * 6/2005 Zhao ..... E04H 1/04 52/79.1
2008/0134601 A1 * 6/2008 Cruz ..... E04B 2/7433 52/236.2
2010/0043719 A1 * 2/2010 Mercier ..... A01K 1/03 119/484
2010/0058675 A1 * 3/2010 Simmons ..... E04B 1/34807 52/745.13
2020/0040594 A1 * 2/2020 Hedberg ..... E04H 1/005
2022/0178134 A1 * 6/2022 Beisl ..... E04H 1/04

* cited by examiner

A

B

C

D

E

BUILDING COMPLEX COMPRISING AT LEAST TWO BUILDINGS, AND BUILDINGS

BACKGROUND OF THE INVENTION

The invention relates to a building complex comprising at least two buildings as well as a building with at least two stories, in particular for such a building complex.

Building complexes are in general constructions that are planned individually and matched to the respective requirements. Therefore, the erection of such building complexes is not only complicated but also primarily expensive.

Buildings require, depending on their size, a considerable footprint that cannot be used for other purposes. Also, the buildings often prevent an air circulation that is required for a good microclimate.

It is the object of the invention to configure the building complex of the aforementioned kind and the building of the aforementioned kind in such a way that a cost-efficient and variable design of building complexes or buildings is possible.

SUMMARY OF THE INVENTION

This object is solved for the building complex of the aforementioned kind in accordance with the invention in that the buildings in width direction and in length direction each have a basic size and that the length and the width of the buildings correspond to the basic size or to a multiple of this basic size.

The object is further solved for a building of the aforementioned kind in accordance with the invention in that the building at its bottom side comprises at least one support that supports the building with formation of a venting space between the ground and the building bottom side and in that the venting space is part of an air circulation flowing about the building.

The building complex according to the invention can be designed very variably due to the design of the buildings according to the invention from which it is erected. Since the buildings are each provided with the basic size, the different buildings for forming the respective building complex can be assembled very easily. Since the widths and lengths of the buildings, depending on their design, can also measure a multiple of the basic size, the individual buildings can be shaped differently and still can be combined to different types of building complexes. The use of the basic size or a multiple of the basic size for the buildings makes it possible to place the buildings adjacent to each other or on top of each other in such a way that, depending on the specifications of the builder, differently designed building complexes can be erected easily.

In an advantageous embodiment, the building comprises straight side sections in width direction and/or in length direction that have a length corresponding to the basic size or a multiple of this basic size. This design of the buildings is in particular advantageous when they are placed adjacent to each other.

In an advantageous configuration, the building can also comprise at least one curved section in width direction and/or in length direction whose radius corresponds to the basic size or a multiple thereof. Thus, buildings with straight outer walls can be joined to each other but also buildings with outer walls that have a curved outer wall section. Since the radius of these curved sections corresponds to the basic size of the respective building or a multiple of this basic size, it is also possible to place, without problems, buildings adjacent to each other that have only straight sections and that have straight as well as curved sections.

A particularly simple design of the building complexes results when the buildings for erecting the building complex are comprised of basic shapes whose width dimensions and length dimensions correspond to the basic size or a multiple of this basic size.

Such basic shapes can be, for example, quadrangles, circles, semicircles, quarter circles and the like but also mixed shapes of quadrangles, circles, semicircles, quarter circles and the like. Thus, with such basic shapes of buildings, building complexes of very different designs can be erected very easily.

The building according to the invention is supported by the at least one support. The support has such a length or height that in the region below the building an air circulation venting space is formed. In this way, an air circulation flowing about the building is ensured which has a particularly advantageous effect on the local microclimate. The support itself requires only a minimal footprint so that the remaining part of the region of the construction area below the building remains available for other purposes. This remaining area can be used, for example, as a parking lot, as a playground, as a green area, as business space, for sports and the like. The support can be designed such that it supports the building reliably.

Advantageously, the support is designed like a stilt. The stilt requires therefore only a minimal footprint so that the primary portion of the ground below the building is available for other uses.

In order for the venting space to have a sufficient height or to enable the various uses below the building, the support has advantageously a length of 2 m to 3 m. The venting space has therefore a sufficient height so that a proper air circulation below the building is ensured also.

The building is comprised of the at least two stories which in an advantageous manner are formed as pre-manufactured units. They can already be pre-manufactured at the factory and then transported to the construction site. The pre-manufactured units can then be easily mounted at the construction site and assembled to the building. Also, it is thereby possible to demount the pre-manufactured unit very easily and to erect the building again, for example, at a different location.

The pre-manufactured units can be transported very easily, in particular by rail.

The stories of the building can also be formed by containers in a further advantageous embodiment. Such stories are suitable for smaller buildings.

The buildings can be designed in a particularly advantageous manner such that they form basic shapes. Very different contours of building complexes can then be assembled from them very easily. Such basic shapes are, for example, rectangles or squares, circles, semicircles but also quarter circles. Semicircles or quarter circles are to be understood herein such that at least one side of a quadrangular story is embodied in an arc shape wherein this arc can then extend across 180° (semicircle) or across 90° (quarter circle). The circles in this context are based on a plan view of the stories.

Depending on the size of the building to be erected, the building can have a width and length of 4.5 m or 9 m. The measure of 3 m is in particular considered when a residential container is used as a building. Such containers have in general the standard size of 3 m×3 m (4.5 m+extension by a modular length of 4.5 m). With such residential containers, stories can therefore be erected that have a width and a height of 3 m as well as a length of at least 4.5 m.

On a wide-body train, 3×3=9 containers with these dimensions can be transported.

The standard size of the buildings, in particular when embodied as a residential building, amounts to 9 m×9 m×(9 m+extension by a modular length of 4.5 m). Such a building has thus, as a standard size, a height and width of 9 m and a length of 9 m, 13.5 m, 18 m, and so on.

The modular length of 4.5 m relative to the length of the building or of the container is not to be understood as limiting. This modular length can also be selected to be different.

The support of the building is held in a foundation in the ground.

It is particularly advantageous when a tank is used as a foundation instead of a conventional foundation. The wall of the tank is selected here such that the wall can absorb the building load through the support.

Depending on the size of the building, a plurality of supports can be provided which are supported on the wall of the tank.

In an advantageous embodiment, the tank can be a water tank that can be, for example, a component of a sanitary installation of the building.

In a plan view of the building, the tank can have a smaller contour than the building which thus projects past the tank. Depending on the requirements, it is also possible to design the contour of the tank such that it corresponds approximately to the contour of the building.

The subject matter of the application not only results from the subject matter of the individual claims but also from all specifications and features disclosed in the drawings and the description. They are, even if they are not subject matter of the claims, claimed as being important to the invention, provided they are novel, individually or in combination, in relation to the prior art.

Further features of the invention results from the additional claims, the description, and the drawings.

BRIEF DESCRIPTION OF THE DRAWINGS

The invention will be explained in embodiments in more detail with the aid of some embodiments that are illustrated in the drawings.

DESCRIPTION OF PREFERRED EMBODIMENTS

The buildings described in the following are advantageously residential buildings but can also be office buildings, storage buildings or also combinations of these different building types. The buildings can be used in numerous ways, for example, at parking lots of supermarkets or in new housing developments. The buildings can be easily erected in gaps of existing developments. Also, the use in developing regions, flood areas or parks is possible in a simple and advantageous way. Since the building can be erected easily and quickly, it can be used also advantageously for erecting student housing.

Figure 1:
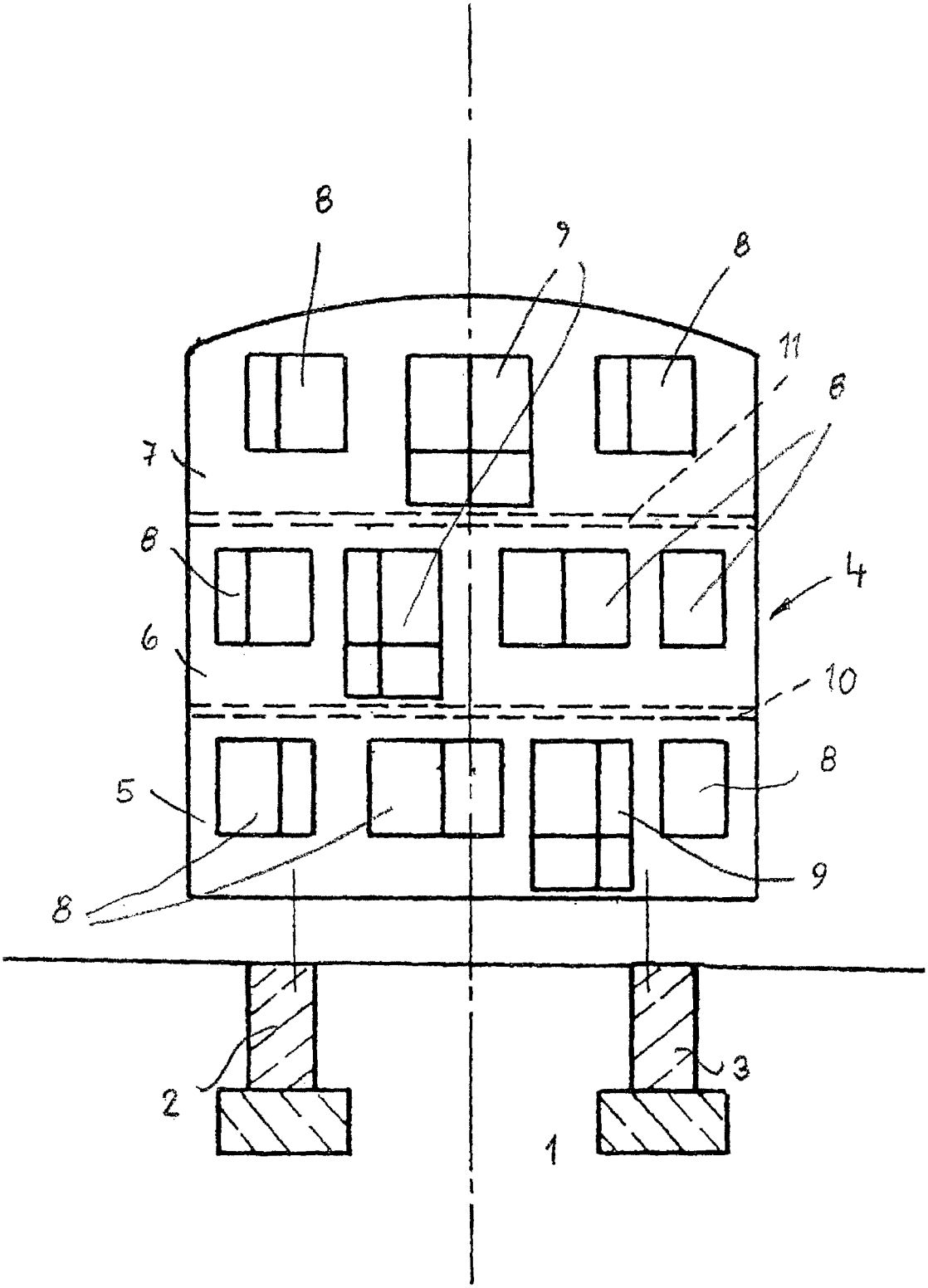
FIG. 1 shows in schematic illustration a building according to the invention located on a wide-body train.

FIG. 1 shows such a building that is designed as a residential building. It is designed such that it can be transported by means of a wide-body train in a simple way. Such a wide-body train is disclosed, for example, in DE 10 2018 003 059. Such a wide-body train is characterized inter alia by its large track gauge that amounts to, for example, 6,000 mm.

In FIG. 1, the wide-body train is only schematically illustrated. It travels on a track 1 with rails 2, 3 which are illustrated in FIG. 1 only schematically. The building 4 is placed on a cargo area of a wagon (not illustrated) of the wide-body train.

The building 4 has, for example, three stories 5 to 7 that each have the same contour. The individual stories 5 to 7 are seated on each other and are fixedly connected to each other in a suitable manner. In FIG. 1, windows 8 and doors 9 are illustrated in an exemplary fashion for the individual stories 5 to 7. The arrangement and distribution of the windows and doors is to be understood only as an example.

The stories 5 to 7 are advantageously identically designed.

Each story 5 to 7 has, for example, a length of 9 m and a width of 9 m so that each story has a floor area of 81 $m^2$.

Each story 5 to 7 contains advantageously an apartment whose configuration can be different from story to story.

The length and/or the width of the story can be extended by a modular length of 4.5 m so that each story 5 to 7 has a length and/or a width of 13.5 m, 18 m, 22.5 m, 27 m, . . . . In this way, the size of the stories 5 to 7 can be varied in regard to the length as well as the width in accordance with the modular length.

The described dimensions are advantageous when using the building 4 as a residential building. The building 4 can also be designed as a residential container. In this case, the individual stories 5 to 7 have smaller widths or lengths, for example, a length of 3 m and a width of 3 m. In this case also the width and/or length of the stories can also be extended by the modular length of, for example, 4.5 m so that the residential containers can be produced in lengths or widths of 9 m, 13.5 m, 18 m, 22.5 m, . . . .

When the building 4 is to be transported by means of a wide-body train, such smaller residential containers can be arranged in three rows adjacent to each other and on top of each other on a corresponding cargo area of a wide-body wagon. In this way, nine residential containers can be accommodated on a cargo area of the wide-body train.

There is moreover the possibility of transporting the individual parts of the building stories 5 to 7 by means of standard trains or trucks.

Figure 2:
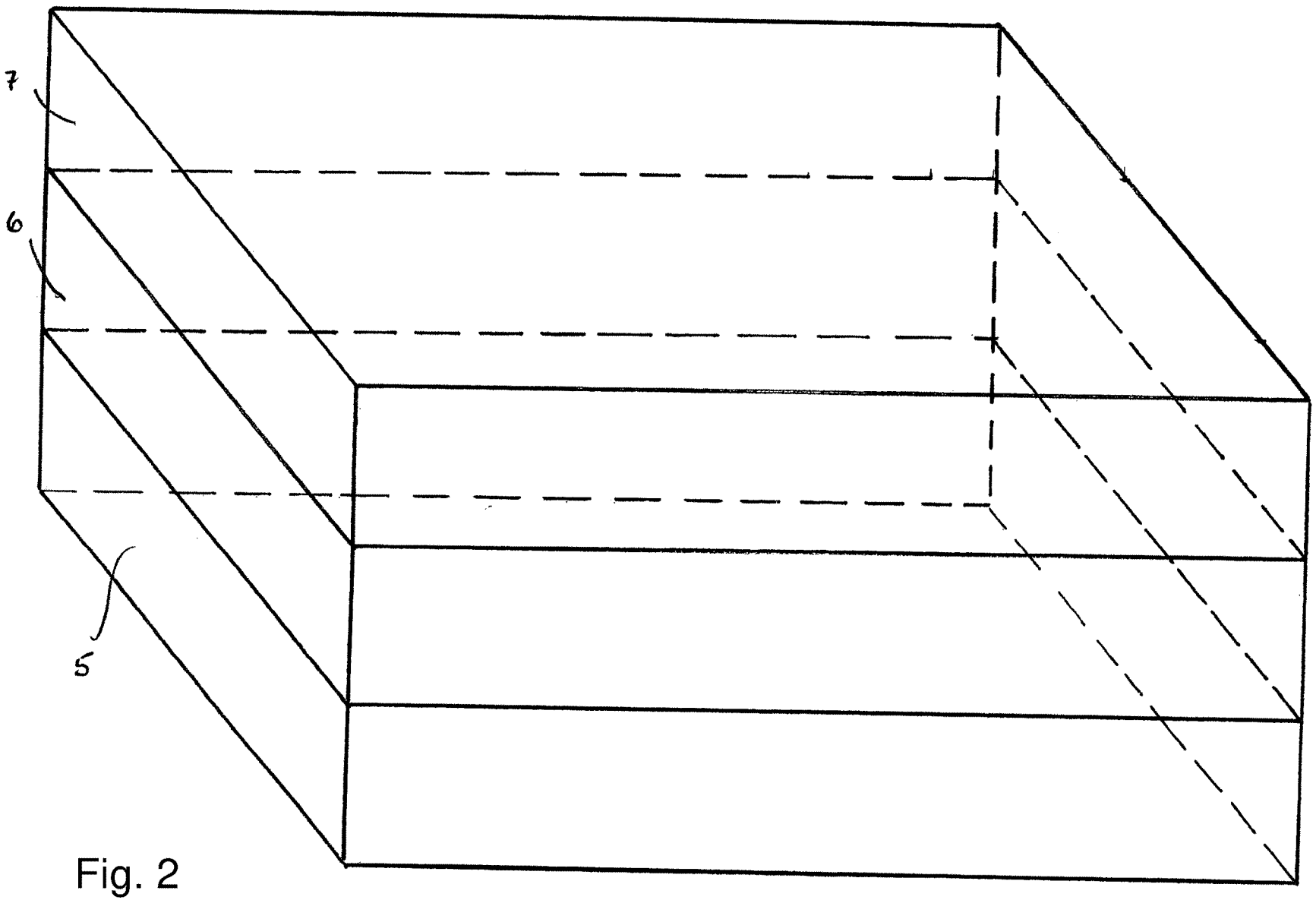
FIG. 2 shows in schematic and perspective illustration three stories of the building according to FIG. 1.

As can be seen in FIG. 2, the individual stories 5 to 7 are placed congruently on top of each other. Between the individual stories, there are intermediate ceilings 10, 11 (FIG. 1) which are not illustrated in FIG. 2 to simplify the drawing. The intermediate ceilings 10, 11 can be formed by the floor or the ceiling of the stories 5 to 7 resting on each other. The intermediate ceilings 10, 11 have a sufficiently high carrying capacity.

The height of the individual stories 5 to 7 depends on the respective conditions. The individual stories 5 to 7 can also have different story heights.

Deviating from the illustrated embodiment, it is possible that the stories 5 to 7 do not have a square shape but a rectangular shape. Advantageously, in this case the length or width of the stories 5 to 7 corresponds to a multiple of a modular length. When the modular length amounts to, for example, 4.5 m, then the story can have approximately a width of 4.5 m and a length of 9 m, 13.5 m etc. or, in case of a length of 4.5 m, a width of 9 m, 13.5 m, and the like.

Figure 3:
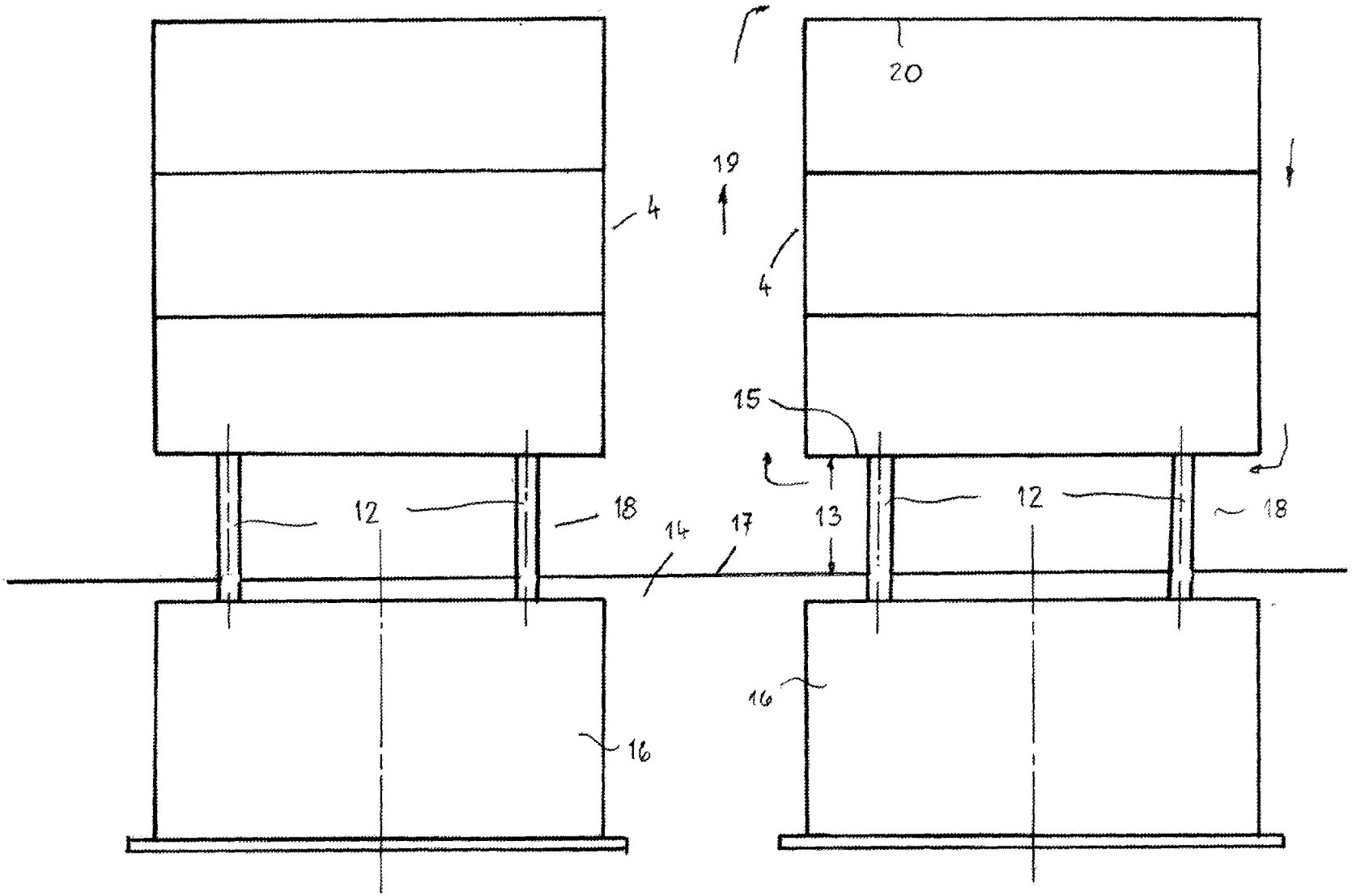
FIG. 3 shows in schematic illustration two adjacently arranged buildings according to the invention, each supported on a tank.

FIG. 3 shows an embodiment of a building 4 that is supported on supports 12. The supports 12 are so long that the clearance 13 between the ground 14 and the bottom side 15 of the building is so large that, for example, vehicles can be parked underneath the building 4. The clearance 13 can be 3 m, for example.

The supports 12 are arranged and distributed across the width and length of the building 4 such that the building 4 can be supported safely on the ground 14.

A preferred embodiment is provided when in the ground 14 in the region below the building 4, for example, a tank 16, in particular a water tank, is located. The tank is designed such that it can support the supports 12 with the building 4. The tank 16 is arranged at a sufficient depth in the ground 14. It serves in the embodiment as a foundation for the building 4.

For example, a container can also be provided in the ground 14 instead of the tank 16 and can be used as lounge area and the like, for example.

In FIG. 3, two buildings 4 are arranged in an exemplary fashion adjacent to each other and are each supported by supports 12 on a respective tank 16.

The topside 17 can be used, for example, as a green area.

Instead of the greening, the soil above the water tank 16 can also be so thick that paths or flowerbeds, for example, can be provided below and also between the buildings 4.

When the area below the buildings 4 is used as a parking lot, for example, then it is advantageous when the parking area is appropriately paved, for example, by paving stones, by tar pavement, and the like. A particular advantage of the support of the buildings 4 on the supports 12 resides in that below the building 4 a venting space 18 is formed so that the air can flow through below the building 4.

When the buildings 4, as illustrated in an exemplary fashion in FIG. 3, are arranged adjacent to each other, then the air can flow in the direction of the flow arrows 19 in a circulating pattern about the building 4.

The tank 16 has such a volume that it supplies the stories 5 to 7 sufficiently with water. It is advantageous when the conduits for the supply of water extend through the supports 12. In principle, it is, of course, also possible to position the conduits from the tank 16 to the building 4 externally on the supports 12. The tank 16 forms a part of the sanitary installation of the building 4.

At the top side 20 of the building 4, for example, photovoltaic elements or solar collector elements can be mounted in a simple way. Also, at the top side 20 of the building 4, required receiving devices such as satellite dishes can be comfortably mounted. Also, greening of the top side 20 is indeed possible.

The building 4 can be easily transported and mounted in the described way. The venting space 18 below the building 4 makes it possible that the air flows about the respective building 4 in circulation.

Instead of the tank 16, a geothermal device, for example, can be provided below the building 4 in the ground 14.

Figure 5:
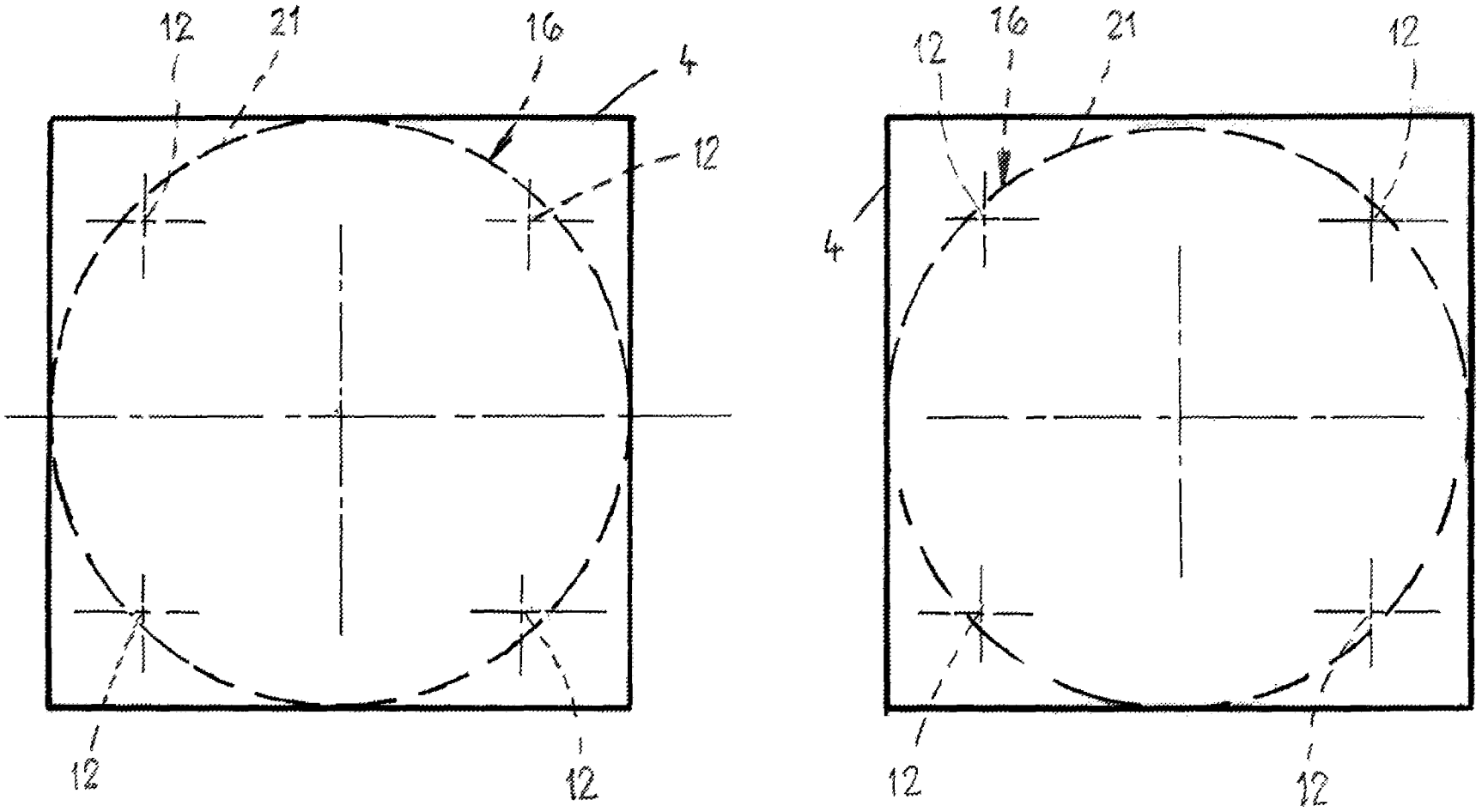
FIG. 5 shows a plan view of the buildings according to FIG. 4.

The tank 16 has advantageously a circular contour (FIG. 5). The diameter of the tank 16 corresponds to the diameter of the inner circle of the building 4, viewed in plan view of the building 4.

The supports 12 that are indicated by the dotted lines are provided in the region of the wall 21 of the tank 16. In this way, the tank can absorb the building load safely.

Figure 4:
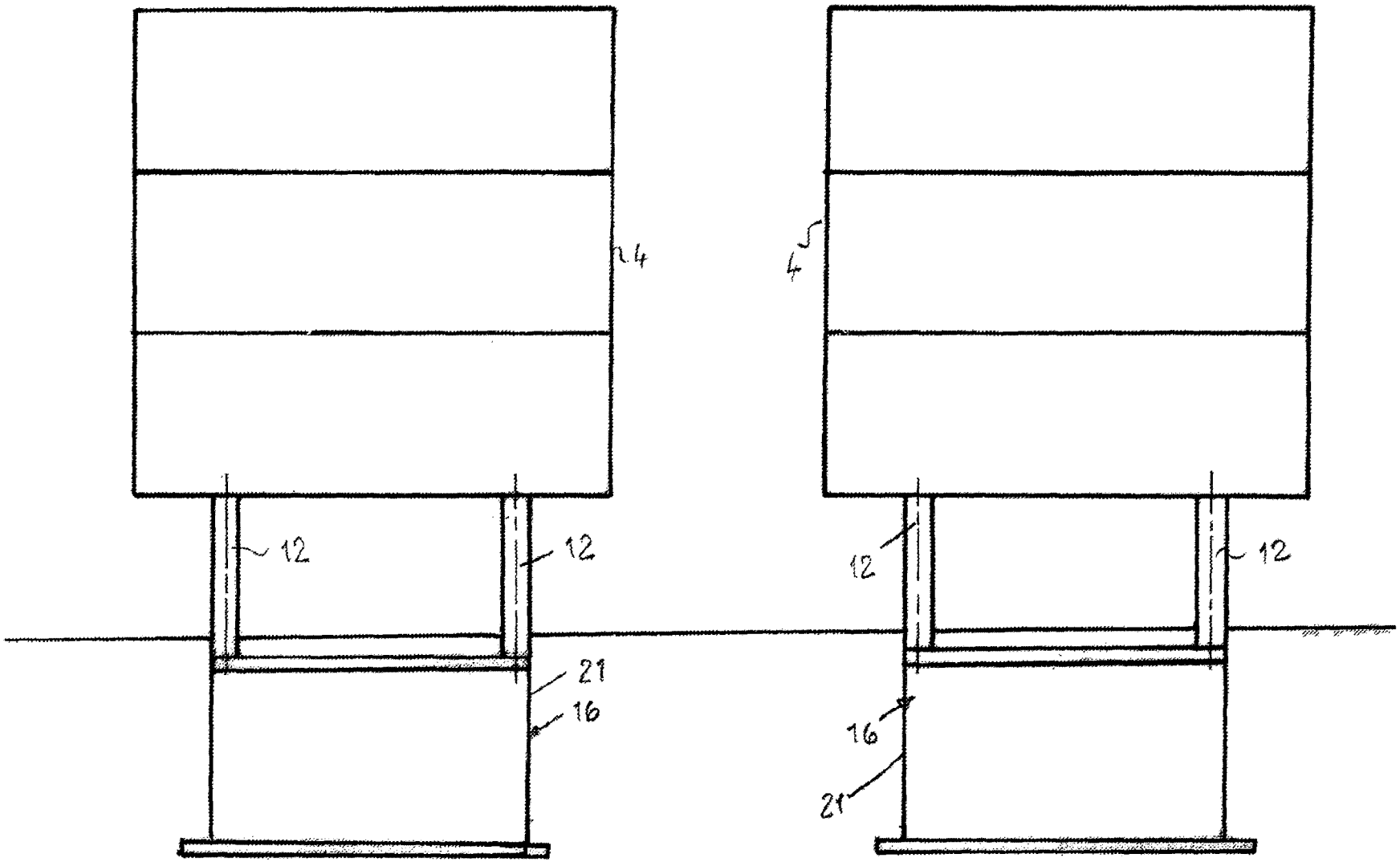
FIG. 4 shows in an illustration corresponding to FIG. 3 a further embodiment of buildings supported on a tank.
Figure 6:
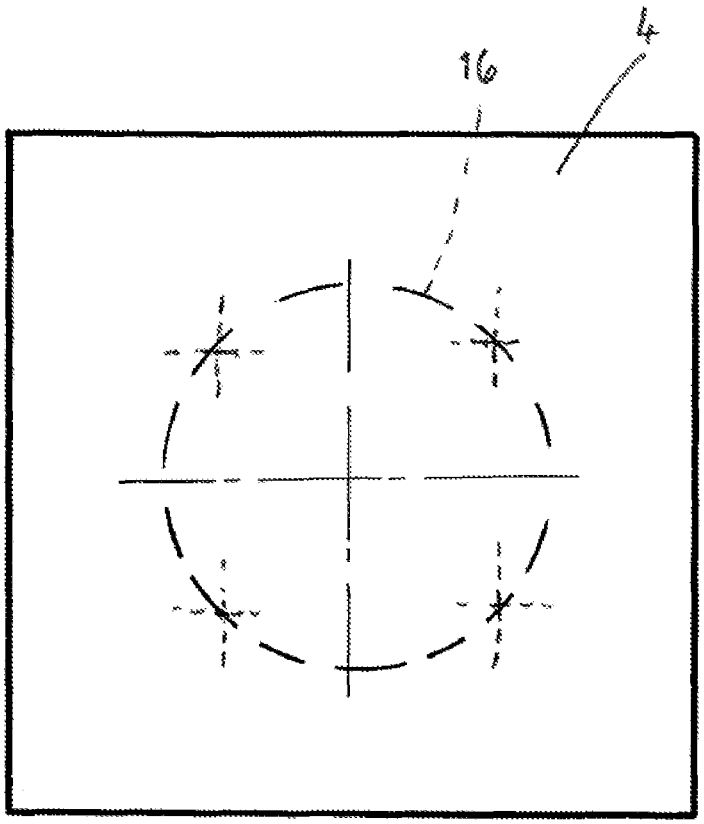
FIG. 6 shows in a plan view an embodiment of a building with a tank underneath.

The embodiment according to FIG. 4 differs from the preceding embodiment only by the size of the tank 16. The tank has, as shown in the plan view according to FIG. 6, a smaller diameter. The building 4 therefore projects on all sides past the tank, viewed in plan view of the building 4.

The building 4 is supported by the supports 12 on the tank 16 near the wall 21.

Figure 7:
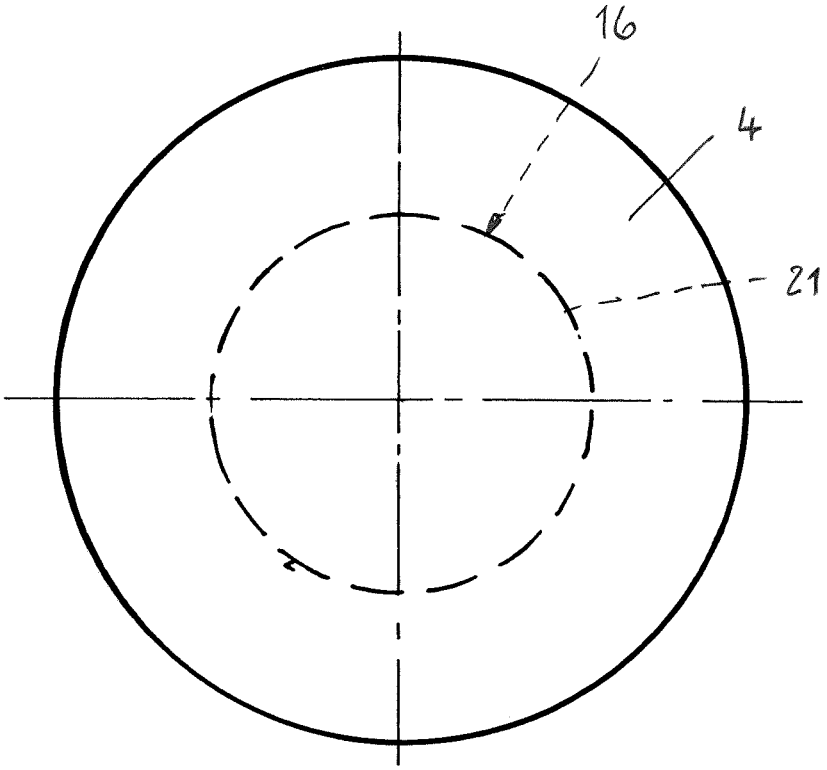
FIG. 7 shows in a plan view an embodiment of a building according to the invention with a tank located underneath.

FIG. 7 shows the possibility that not only the tank 16 but also the building 4 has a circular contour. In the illustrated embodiment, the tank 16 has a smaller diameter than the building 4. It is supported in the described manner by means of the supports (not illustrated) on the tank 16.

The tank 16 can also have the same diameter as the building 4. The support of the building 4 is then realized again by the supports (not illustrated) in the region of the wall 21 of the tank 16.

Figure 8:
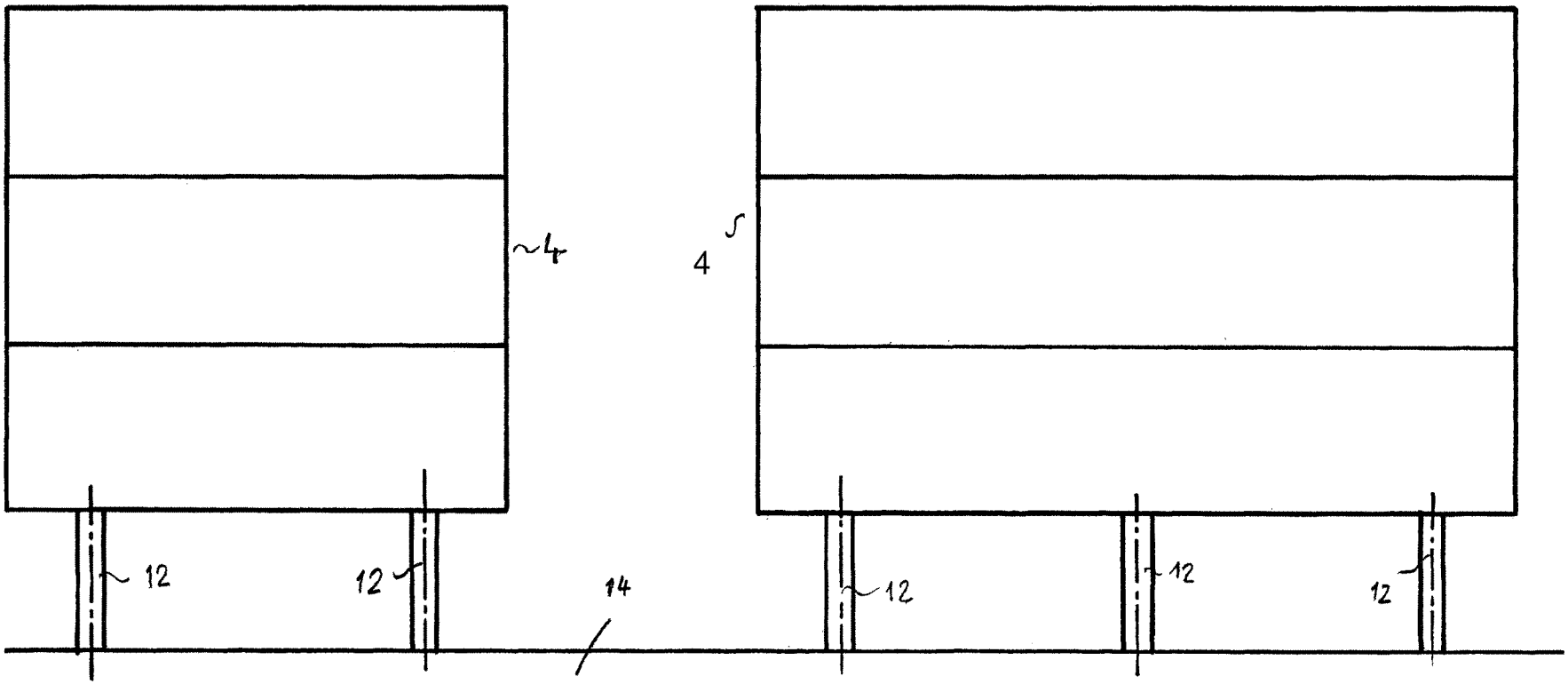
FIG. 8 shows in an illustration corresponding to FIG. 3 a further embodiment of adjacently arranged buildings according to the invention.

FIG. 8 shows the possibility that the buildings 4 have different sizes. The left building 4 has a smaller width than the building 4 to the right. Accordingly, the building 4 to the right is supported by a larger number of supports 12 in the ground 14 than the left building 4.

Also, the adjacently positioned buildings 4 must not be oriented in the same direction. The correlation of neighboring buildings 4 can be arbitrary and depends on the respective local conditions.

Figure 9:
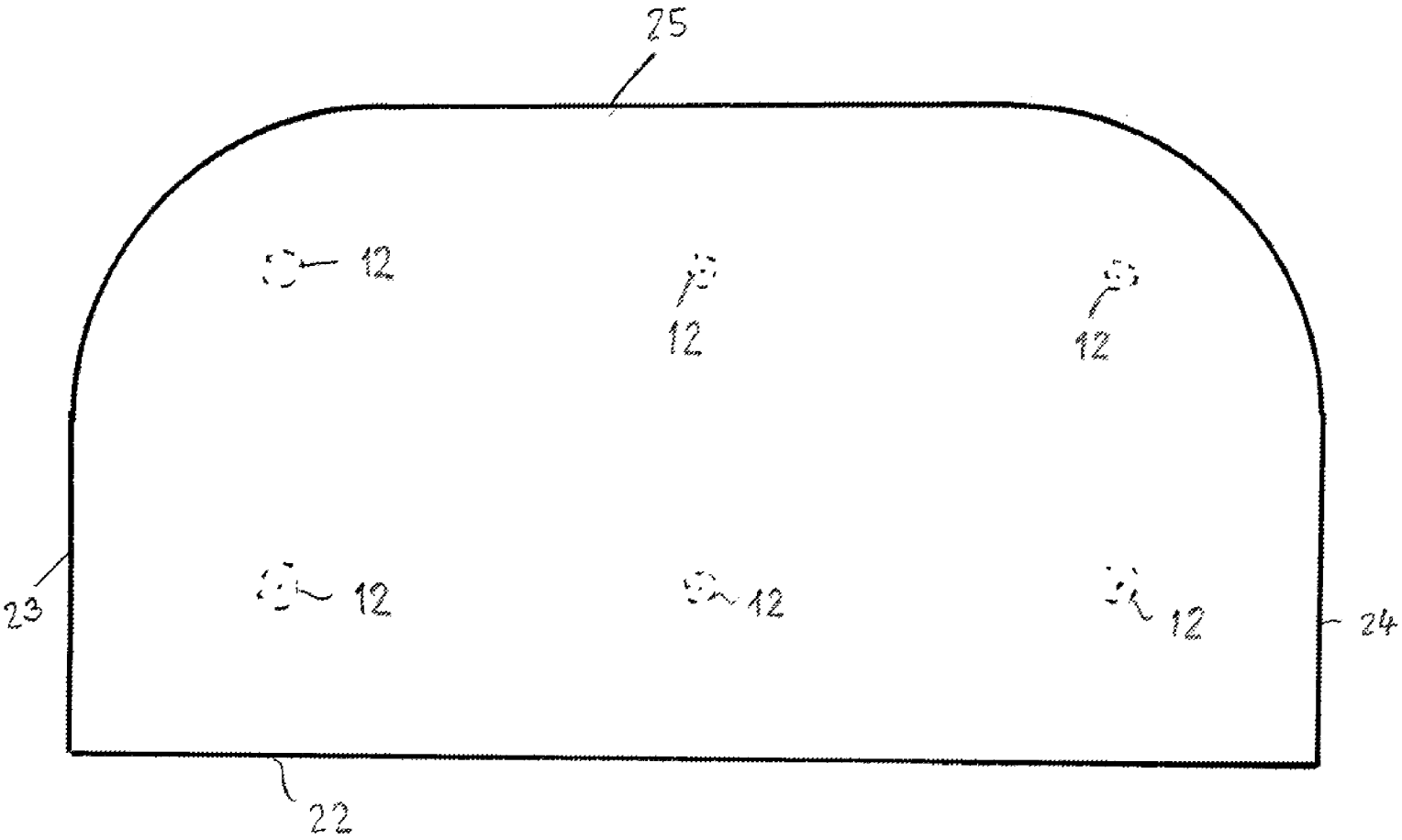
FIG. 9 shows in a plan view a further embodiment of a building according to the invention.

FIG. 9 shows a possible design of the building 4 or of its stories 5 to 7. The building 4 has the longitudinal side 22 that connects two parallel narrow sides 23, 24 that extend at a right angle to the longitudinal side 22. The longitudinal side 25 that is oppositely positioned to the longitudinal side 22 and extends parallel thereto passes in an arc shape (quarter circle) into the narrow sides 23, 24.

The buildings are advantageously supported by six supports 12 that, depending on the size of the building 4, are arranged in distribution across its bottom side. The supports 12 can be arranged on the tank 16 in the described manner or held in the ground 14.

Figure 10:
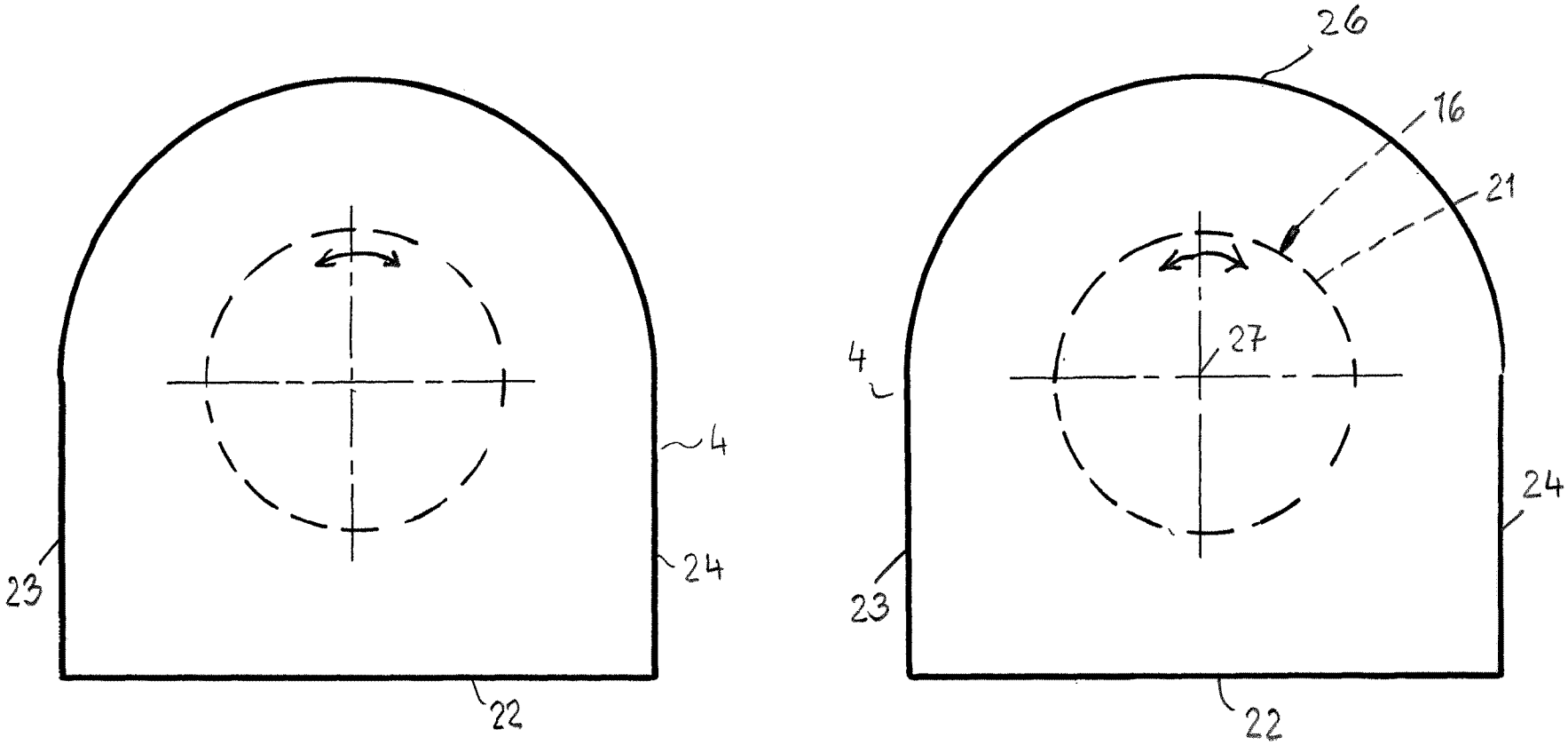
FIG. 10 shows in an illustration corresponding to FIG. 5 a further embodiment of adjacently arranged buildings according to the invention.

The buildings 4 according to FIG. 10 have the longitudinal side 22 and the narrow sides 23, 24 adjoining it at a right angle. In contrast to the preceding embodiment, the two narrow sides 23, 24 are connected to each other by an outer side 26 that is semicircular in plan view. This curved outer side 26, as can be seen in FIG. 10, can have the same center of curvature 27 as the wall 21 of the tank 16 arranged in the region below the building 4.

The building 4 is supported again by the supports 12 (not illustrated) on the tank 16.

Instead of the tank 16 in accordance with the preceding embodiments, a foundation can also be provided in the ground 14 in which the supports 12 are fastened.

Figure 11:
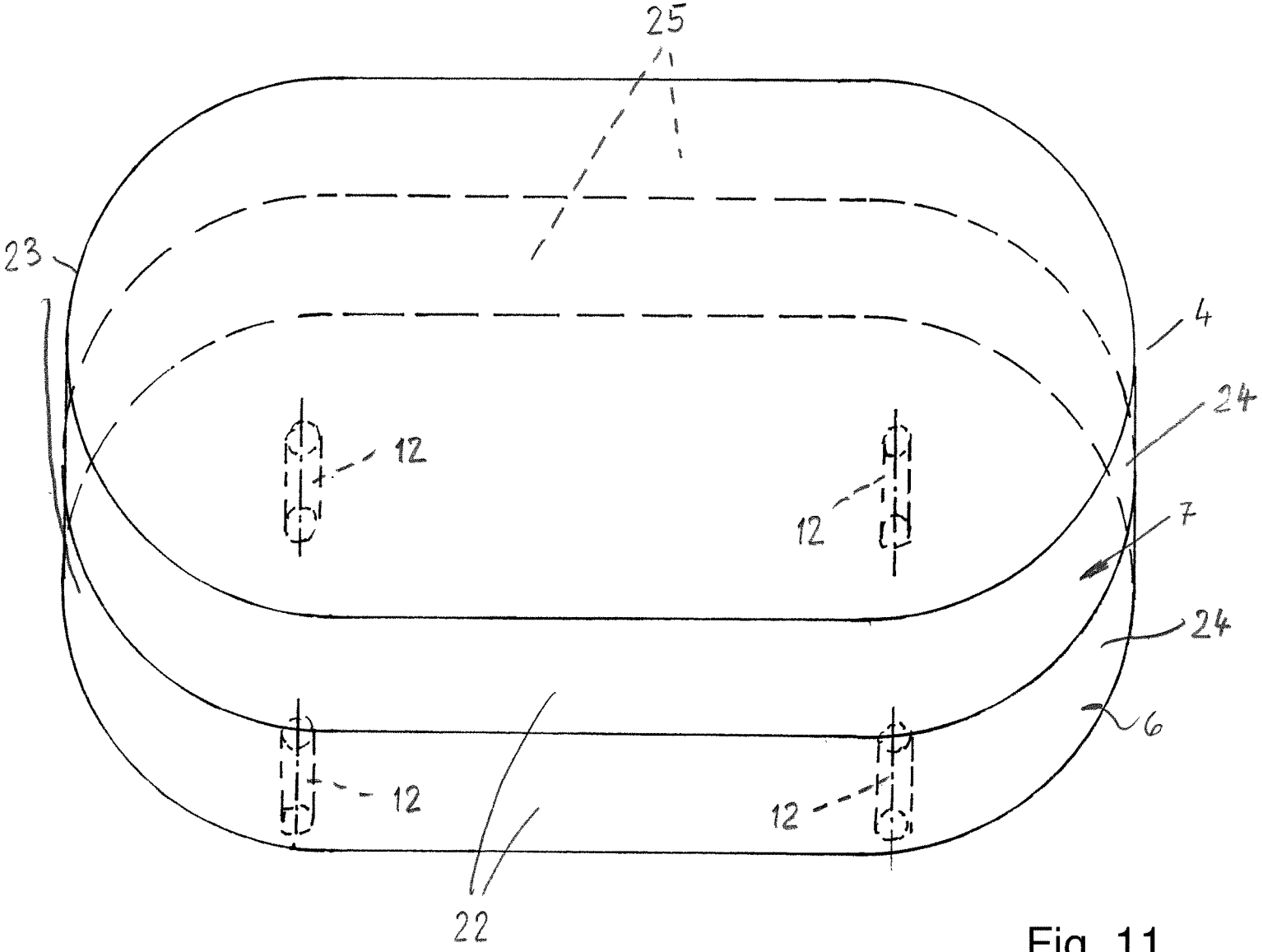
FIG. 11 shows in schematic and perspective illustration a further embodiment of a building according to the invention.

FIG. 11 shows a building 4 that is comprised of only two stories 6 and 7 that are positioned on top of each other and are advantageously of the same configuration. The stories 6, 7 have the longitudinal sides 25, 22 that are oppositely positioned to each other and extend parallel to each other and are connected to each other by part circular, preferably semicircular sidewalls 23, 24.

At the bottom side of the bottom story 6, there are the supports 12 by means of which the building 4 is supported in the ground.

Figure 12:
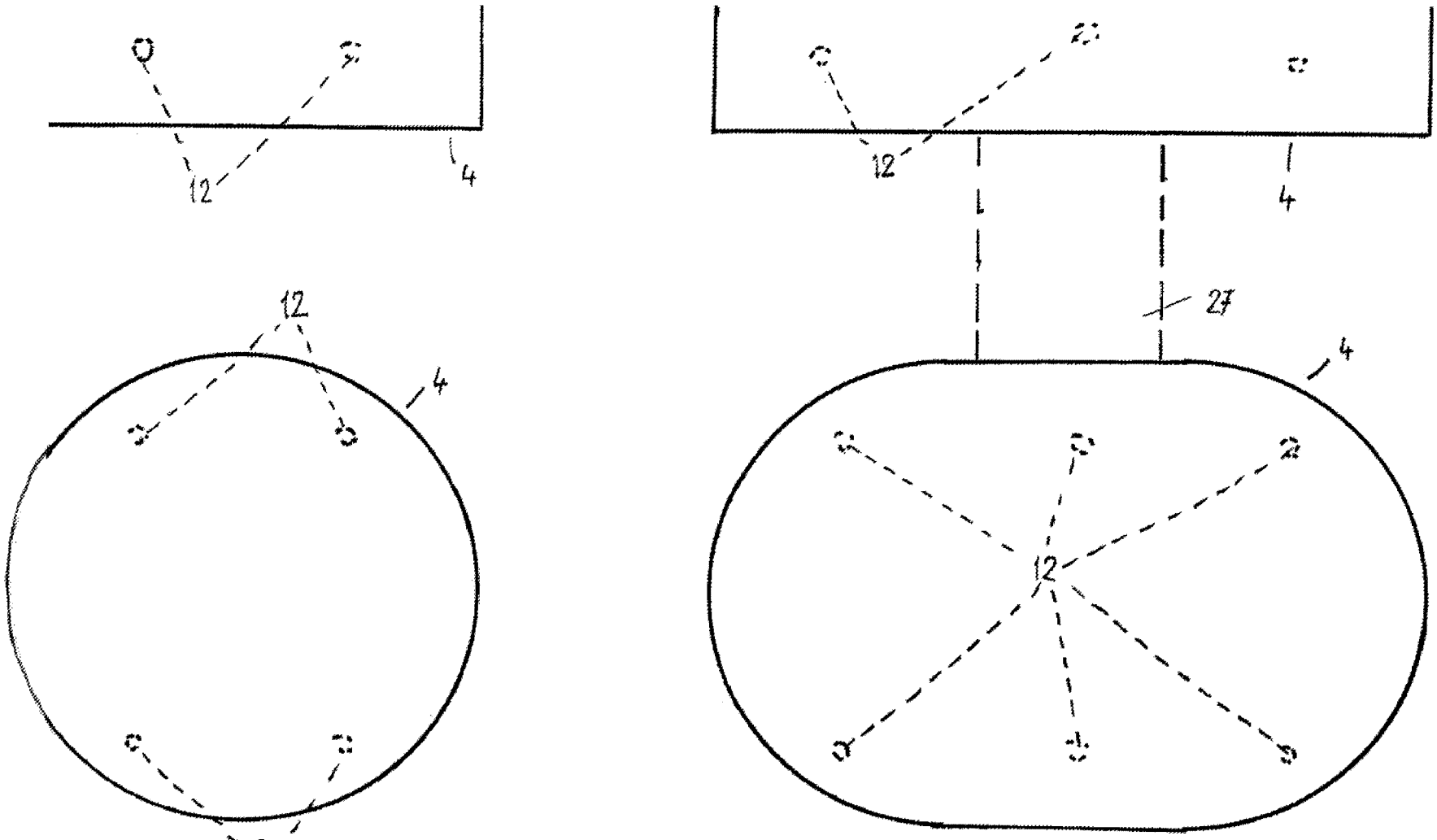
FIG. 12 shows in an illustration corresponding to FIG. 5 further embodiments of buildings according to the invention.

FIG. 12 shows in an exemplary fashion a residential development whose buildings 4 have different contours. The two upper buildings 4 are embodied in accordance with the embodiment according to FIG. 8. The lower left building 4 has a circular contour. The lower right building has a shape in accordance with FIG. 11.

In FIG. 12, it is indicated that the different buildings are connected to each other by a corridor 27. In FIG. 12, the corridor 27 is provided in an exemplary fashion between the upper right and the lower right buildings 4.

Below the buildings 4, tanks and the like can be provided on which the buildings are supported in the described manner by means of the supports 12. Instead of the tank 16, a usual foundation can be provided also.

There is also the possibility of providing such a tank only below one or a plurality of the buildings 4.

Since the buildings 4 are placed on the supports 12, it is not necessary to build on the ground. Therefore, the area that is covered by the buildings 4 can still be utilized, be it as a parking lot, as a green area, as small gardens and the like. Due to the venting spaces 18 below the buildings 4, a continuous air circulation is provided that has a positive effect on the local microclimate.

The building 4 or the respective story can be produced in a filigree lightweight construction. The individual elements can be assembled in a modular system to the respective story. For the building 4, recyclable materials can be used in an environmentally friendly manner.

The individual elements of which the buildings 4 are assembled are easily demountable in an advantageous manner so that the buildings 4 or the stories 5 to 7 can be rebuild at a different location any time.

Wood is used as a preferred construction material. For the supports 12, reinforced concrete with covers of stainless steel, steel or plastic pipes can be used in an advantageous manner. The covers prevent carbonization of the concrete and can be provided any time with a corresponding protection.

The sanitary and energy supply of the buildings 4 is realized substantially autonomously as has been described before, for example, by use of the tank 16, the photovoltaic or solar collector elements on the building roof, the satellite dishes or other antennae and the like.

The buildings 4 are advantageously used as residential homes that are primarily supported on the supports 12. Therefore, in the described way the areas below the buildings can be used as parking lot, playground, green areas, business space, for sports activities and the like. Due to the described air circulation below the building 4, the microclimate is also improved.

In the illustrated and described embodiments, the buildings 4 are constructed of the same stories. However, it is also possible to use differently shaped stories.

FIGS. 13*a* to 13*e* show further basic shapes of buildings.

In the following described embodiments, the different basic shapes have a basic size of 4.5 m as an example. The widths and lengths of the basic shapes correspond to this basic size or a multiple of the basic size.

Figures 13A, 13B, 13C, 13D, 13E:
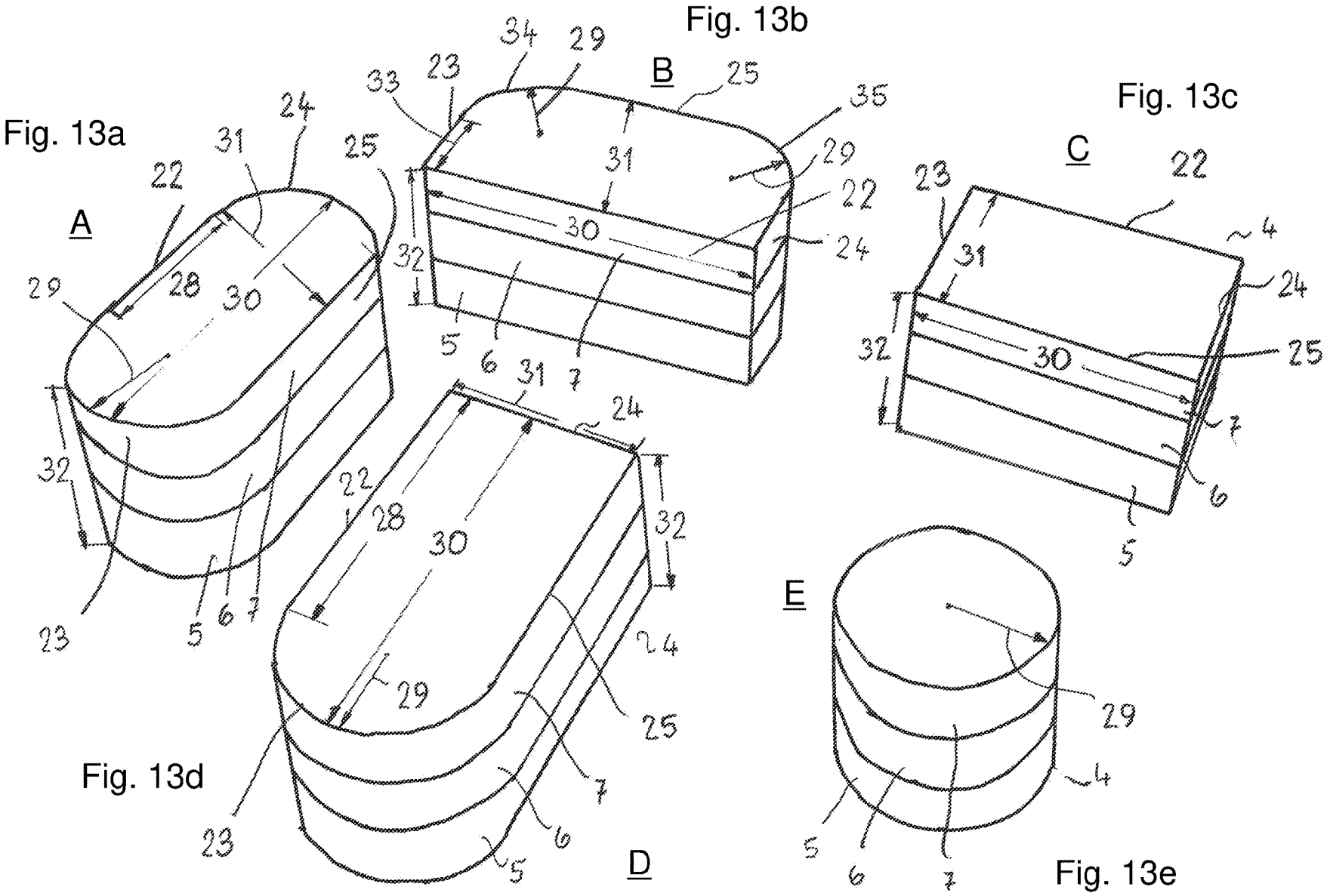
FIGS. 13*a*, 13*b*, 13*c*, 13*d*, and 13*e* show different basic shapes of buildings in schematic illustration.

FIG. 13*a* shows a basic shape A of a building as it has been described in connection with FIG. 11. The basic shape A has parallel extending longitudinal sides 22, 25 that pass into each other by semicircular sidewalls 23, 24. The longitudinal sides 22, 25 have a length 28 which in the embodiment is 9 m.

The sidewalls 23, 24 have a radius 29 (basic size) which in the embodiment is 4.5 m, i.e., corresponding to half the length 28 of the longitudinal sides 22, 25.

The basic shape A comprises thus a total length of 18 m in the example. The width 31 of the basic shape A measured between the longitudinal sides 22, 25 amounts to 9 m for the dimensions that are provided as an example; this corresponds to twice the basic size of 4.5 m.

The height 32 of the basic shape A with the three stories 5 to 7 amounts to 9 m in the example.

The basic shape B according to FIG. 13*b* has already been described in connection with FIG. 9. The basic shape B has the longitudinal side 22 adjoined at its ends at a right angle by the narrow sides 23, 24. They connect the longitudinal side 22 to the parallel extending longitudinal side 25.

The longitudinal side 22 has as an example a total length 30 of 13.5 m. The width 31 amounts to 9 m in the example.

The parallel extending narrow sides 23, 24 have the length 33 which in the embodiment amounts to 4.5 m, i.e., corresponds thus to the basic size.

The transition sections 34, 35 located between the narrow sides 23, 24 and the longitudinal side 25 each have a radius of curvature 29 which amounts to 4.5 m in the embodiment.

The basic shape B has again three stories 5 to 7 which each have a height of 3 m so that the height 32 of the basic shape B amounts to 9 m.

The basic shape C according to FIG. 13*c* shows a building with rectangular contour. The basic shape C has the longitudinal sides 22, 25 positioned opposite to each other and extending parallel to each other as well as the parallel extending narrow sides 23, 24. The longitudinal sides 22, 25 have a length 30 which amounts to 13.5 m in an exemplary fashion. The width 31 of the basic shape C amounts to 9 m in the embodiment. The height 32 of the basic shape C also amounts to 9 m in the embodiment.

The building 4 according to the basic shape C has three stories 5 to 7 that are positioned above each other and, corresponding to the described embodiments, each have the same contour.

In accordance with the preceding embodiments, the stories 5 to 7 have each the same height, for example, a height of 3 m.

The building 4 with the basic shape D (FIG. 13*d*) has the two parallel positioned longitudinal sides 22, 25 which at one end are connected to each other by the narrow side 24 that is positioned at a right angle to them. The length 28 of the longitudinal sides 22, 25 amounts to 4.5 m in the embodiment.

At the other end, the two longitudinal sides 22, 25 are connected to each other by the narrow side 23 which has a semicircular contour. The narrow side 23 has the radius of curvature 29 which amounts to 4.5 m in the embodiment. Thus, the total length 30 of the basic shape D amounts to 13.5 m in the embodiment.

As an example, the width 31 and the height 32 amount to 9 m, respectively.

The building 4 has three stories 5 to 7 which each have the same contour shape and are seated on top of each other in accordance with the other embodiments.

The building 4 of the shape E (FIG. 13*e*) has a cylinder shape. The radius 29 amounts to, for example, 4.5 m so that the basic shape E has a diameter of 9 m. The basic size in this case is the radius 29.

The building 4 has again the stories 5 to 7 positioned on top of each other which each have the same contour.

Figure 14:
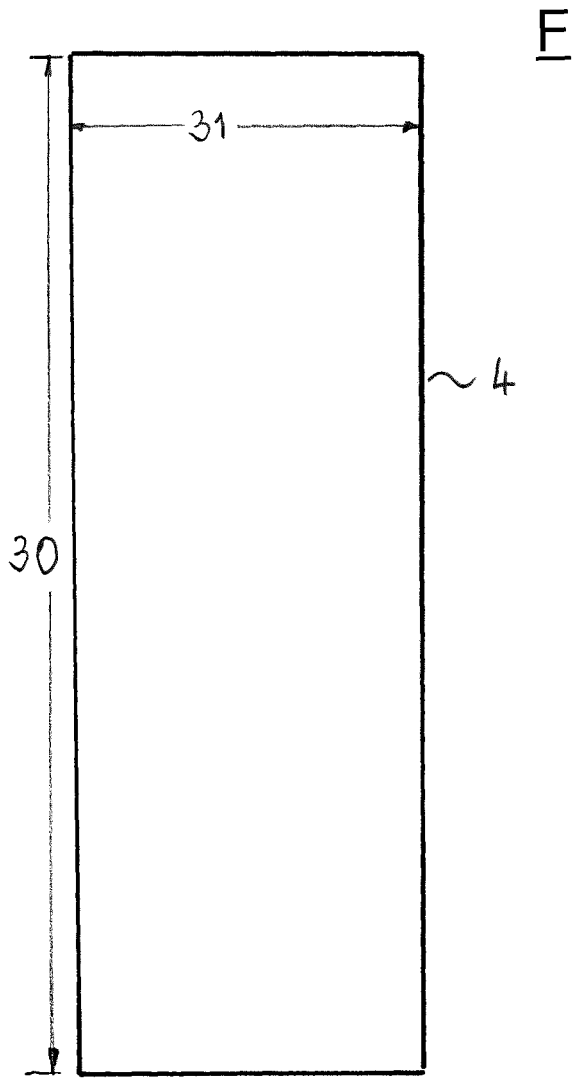
FIG. 14 shows another basic shape of a building in schematic illustration.

FIG. 14 shows in plan view a further basic shape F of a building 4 that has a rectangular contour. In contrast to the basic shape C (FIG. 13*c*), the basic shape F has a width 31 corresponding to half the width 31 of the basic shape C, in the embodiment accordingly 4.5 m. The basic shape F in other respects has the same length 30 and the same height 32 as the embodiment according to FIG. 13*c*.

Figure 15:
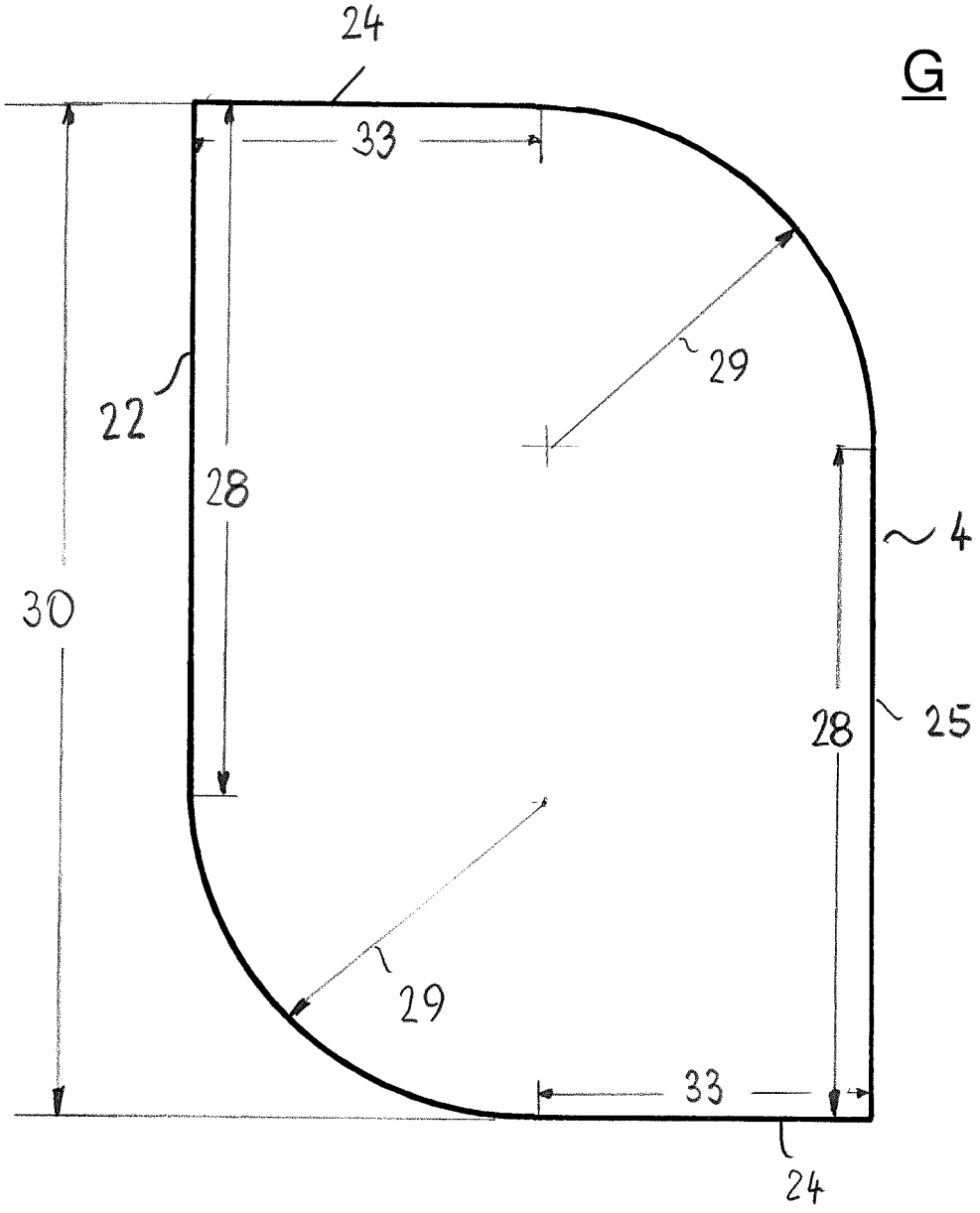
FIG. 15 shows another basic shape of a building in schematic illustration.

FIG. 15 shows a basic shape G of a building 4 that comprises the two longitudinal sides 22, 25 which extend parallel to each other but in longitudinal direction are displaced relative to each other. Both longitudinal sides 22, 25 have each the same length 28 which in the embodiment amounts to 9 m.

The ends of the longitudinal sides 22, 25 facing away from each other are positioned at a right angle relative to the narrow sides 23, 24 that each have the length 33 which amounts to 4.5 m in the embodiment. Therefore, the basic shape G has a total length 30 of 13.5 m in the embodiment.

The building 4 according to FIG. 15, as in the preceding embodiments, comprises the three stories which are congruently placed on top of each other.

Figure 16:
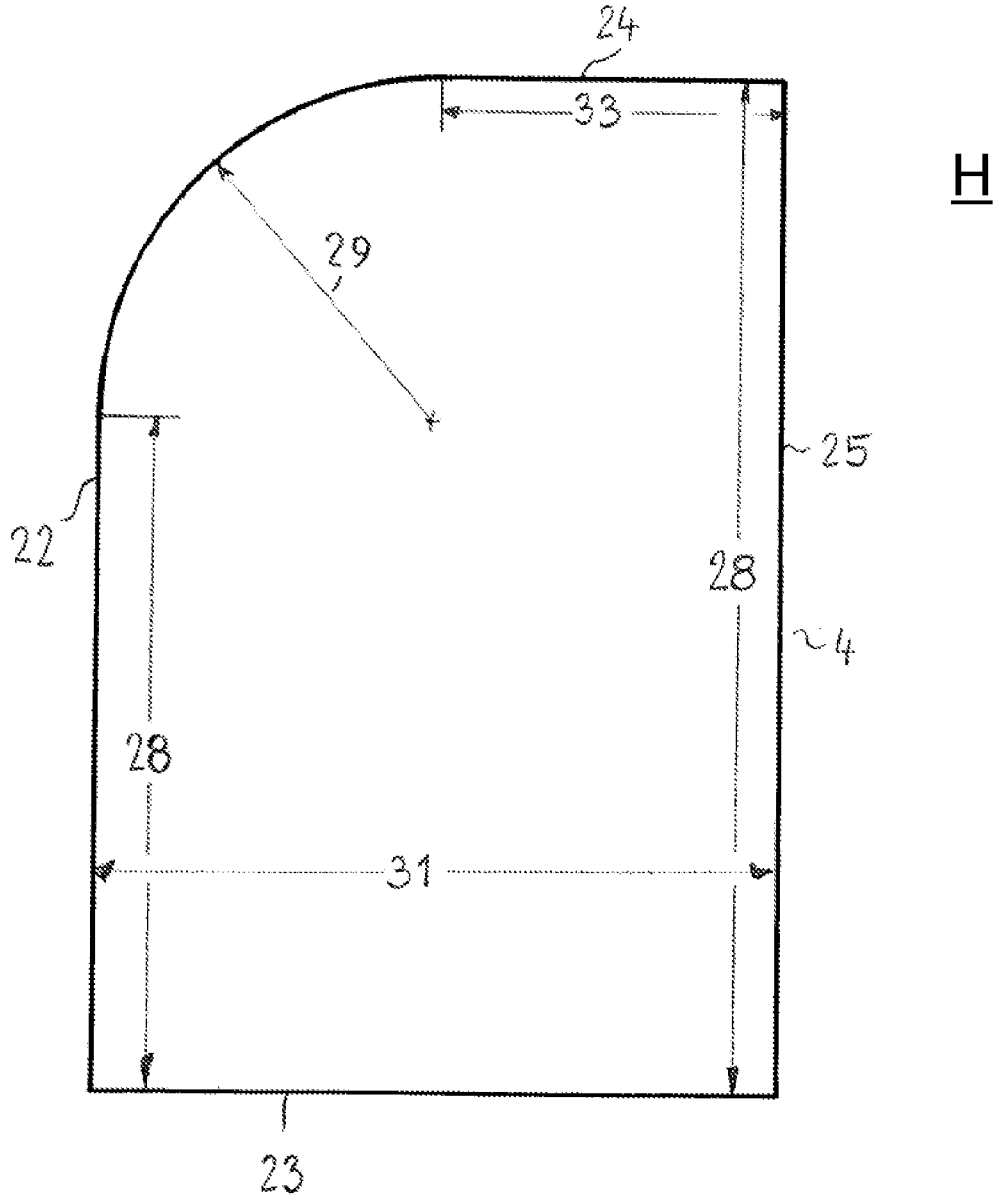
FIG. 16 shows another basic shape of a building in schematic illustration.

FIG. 16 shows a building 4 in a basic shape H. It is characterized in that the longitudinal sides 22, 25 at one end are connected to each other by the narrow side 23 extending at a right angle to them. In the embodiment, it has a length of 9 m so that the building 4 as a whole has a width 31 of 9 m in the embodiment.

The two longitudinal sides 22, 25 have different lengths. The longitudinal side 22 has a length 28 which in the embodiment amounts to 9 m. The oppositely positioned longitudinal side 25 has in contrast thereto a length 28 of 13.5 m.

The two narrow sides 23, 24 which are positioned opposite each other also have different lengths. The narrow side 24 which is positioned at a right angle to the longitudinal side 25 has a length 33 which amounts to 4.5 m in the embodiment.

The transition between the narrow side 24 and the longitudinal side 22 has the radius of curvature 29 of 4.5 m.

This basic shape H has also stories that are congruently positioned on top of each other as has been described in the preceding embodiments.

Figure 17:
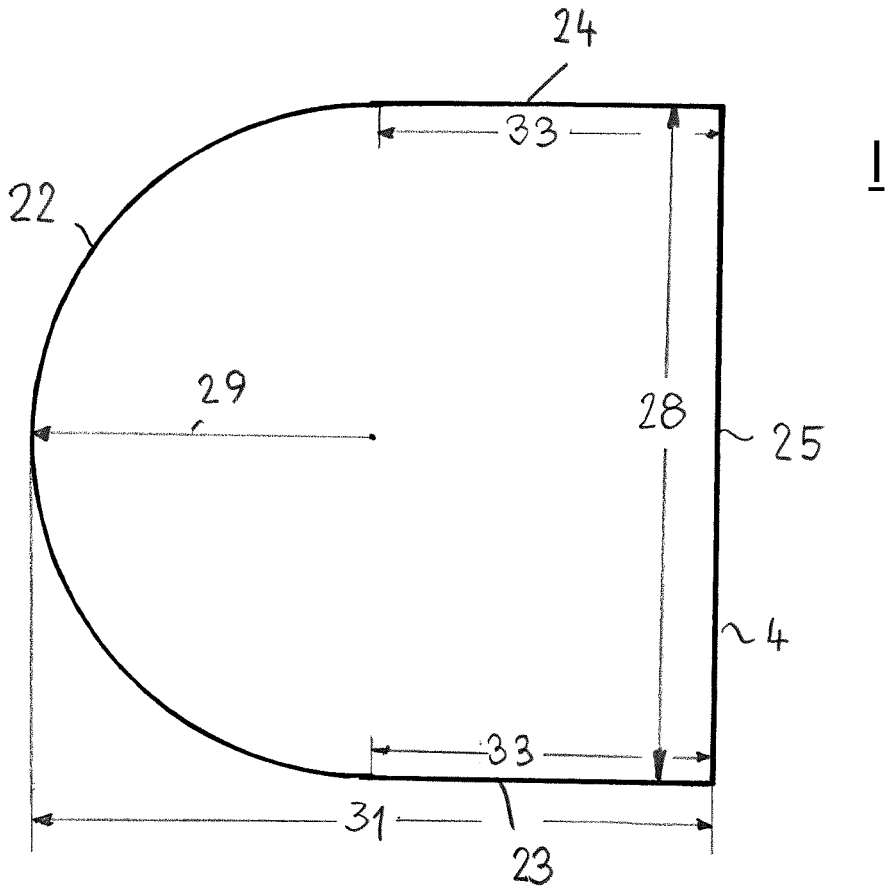
FIG. 17 shows another basic shape of a building in schematic illustration.

FIG. 17 shows a building 4 with a basic shape I which has the longitudinal side 25 whose length 28 in the embodiment amounts to 9 m.

The narrow sides 23, 24 adjoin at a right angle the two ends of the longitudinal side 25; they have the same length and each have a length 33 of 4.5 m.

The two narrow sides 23, 24 are connected to each other by a longitudinal side 22 which in contour has a semicircular shape whose radius of curvature 29 amounts to 4.5 m. Therefore, the basic shape I has a width 31 of 9 m at the apex of the curved longitudinal side 22.

Figure 18:
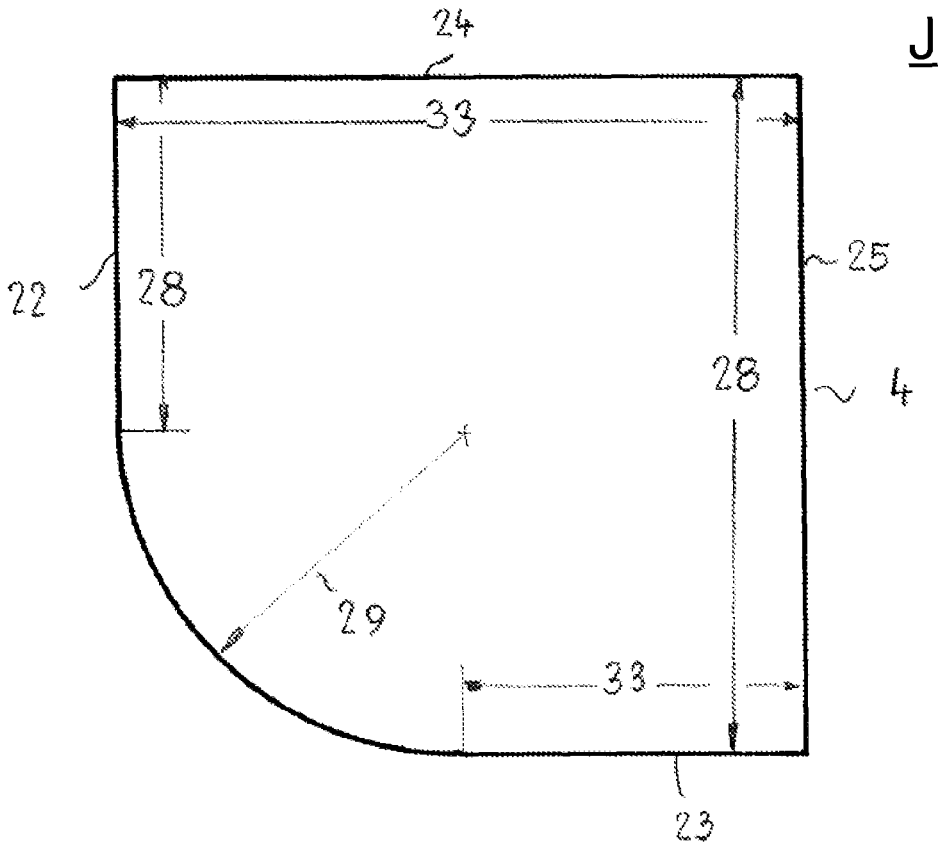
FIG. 18 shows another basic shape of a building in schematic illustration.

The building 4 according to FIG. 18 has the basic shape J. The longitudinal side 25 has the length 28 of 9 m. The narrow side 24 adjoining at a right angle the longitudinal side 25 has also a length 33 of 9 m.

The longitudinal side 22 which adjoins perpendicularly the narrow side 24 is only half as long as the oppositely positioned narrow side 25 and has accordingly a length 28 of 4.5 m.

The narrow side 23 which adjoins at a right angle the longitudinal side 25 is again only half as long as the oppositely positioned parallel narrow side 24 so that the length 33 amounts to 4.5 m.

The transition between the longitudinal side 22 and the narrow side 23 is curved wherein the radius of curvature 29 amounts to 4.5 m. The arc section extends in this embodiment about an angle range of 90°, similar to the embodiment according to FIGS. 15 and 16.

The basic shape J has also stories that are congruently placed on top of each other.

Figure 19:
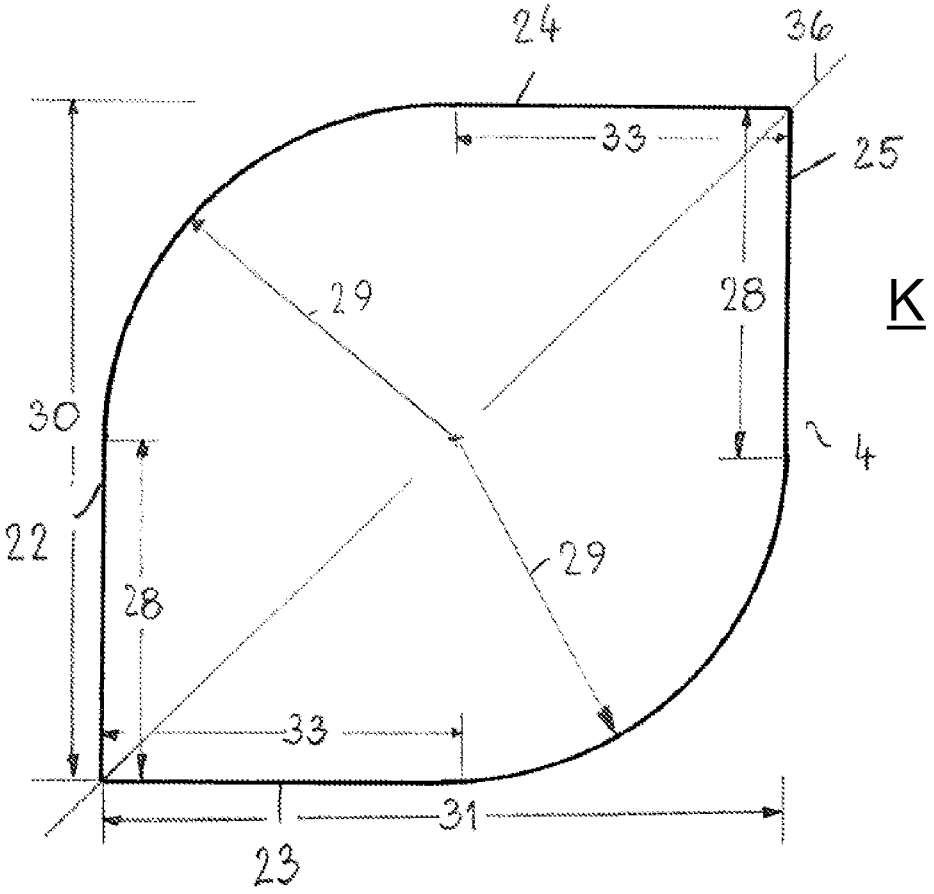
FIG. 19 shows another basic shape of a building in schematic illustration.

FIG. 19 shows a building 4 with a basic shape K in which the longitudinal sides 22, 25 extend parallel to each other but are displaced relative to each other. Both longitudinal sides 22, 25 have the length 28 which in the embodiment amounts to 4.5 m.

The narrow side 23, 24 adjoins at a right angle one end of the longitudinal sides 22, 25 whose length 33 amounts to 4.5 m, respectively. The narrow sides 23, 24 are also displaced relative to each other.

The longitudinal side 22 and the narrow side 24 pass into each other bent in an arc shape. Also, the longitudinal side 25 passes, bent in an arc shape, into the narrow side 23. The radius of curvature 29 of these curved sections amounts to 4.5 m.

The total length 30 and the total width 31 of the basic shape K amounts thus to 9 m, respectively.

The basic shape K is embodied mirror-symmetrical in relation to a straight line 36 passing through the corners, viewed in plan view.

This building 4 also comprises a plurality of stories that are congruently placed on top of each other, as has been described in the preceding embodiments.

Figure 20:
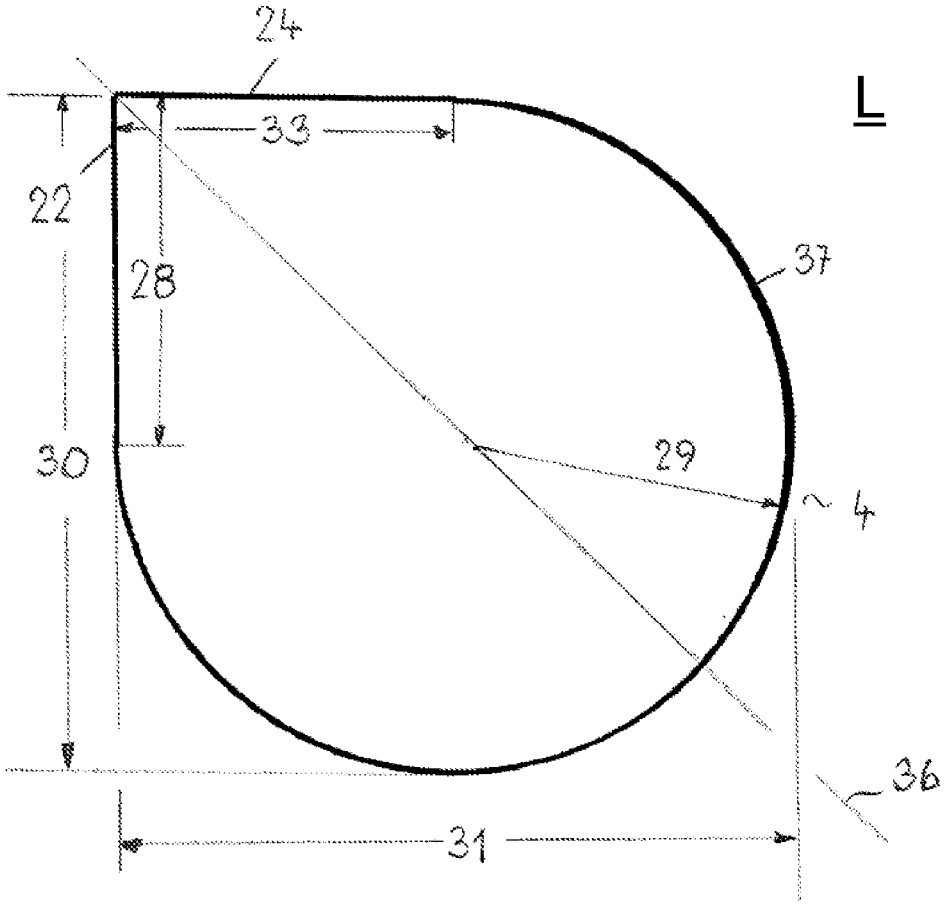
FIG. 20 shows another basic shape of a building in schematic illustration.

In the embodiment according to FIG. 20, the building 4 has the basic shape L which in plan view has the shape of a drop. The building 4 has the narrow side 24 as well as the longitudinal side 22 that adjoins it at a right angle thereto. Both sides 22, 24 have each a length 28, 33 that amounts to 4.5 m in the embodiment, respectively. The ends of the longitudinal side 22 and of the narrow side 24 are connected to each other by a side 37 extending about an angle range of 270°. The radius of curvature 29 of this side 37 amounts to 4.5 m.

This basic shape L also has, similar to the preceding basic shape K, a total length 30 and a total width 31 of 9 m, respectively.

In relation to the straight line 36, in a plan view, the basic shape L is mirror-symmetrically embodied.

This basic shape L has also stories that are congruently placed on top of each other.

Figure 21:
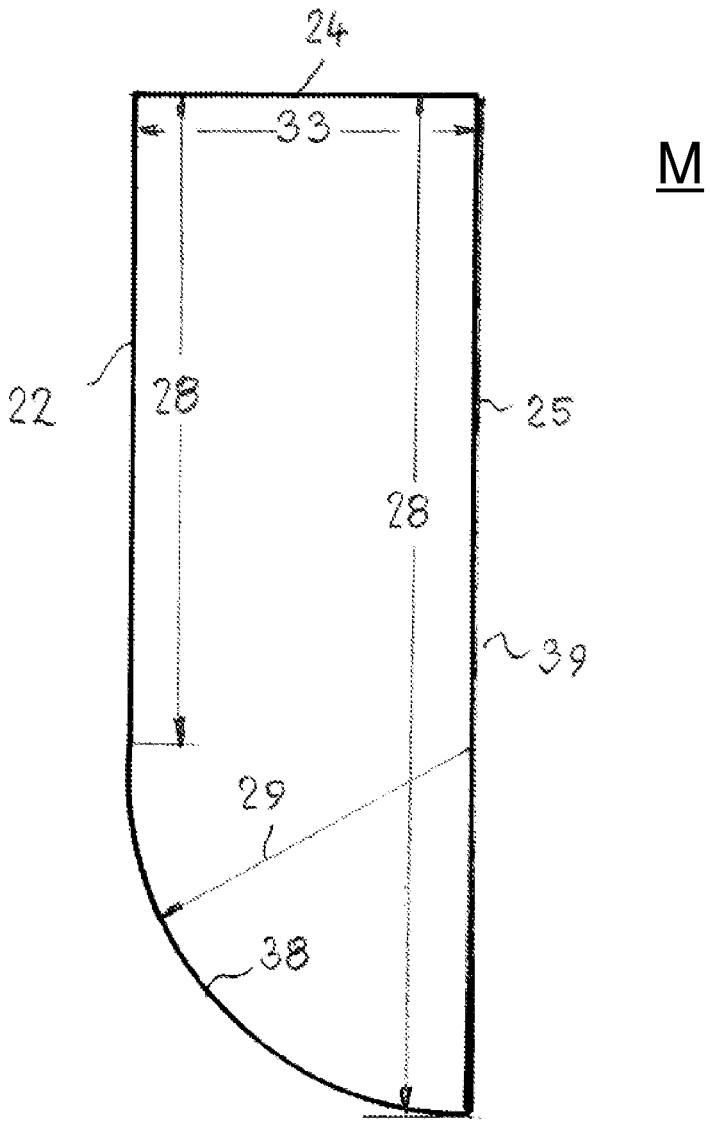
FIG. 21 shows another basic shape of a building in schematic illustration.

FIG. 21 shows an annex with a basic shape M. It has the two longitudinal sides 22, 25 that extend parallel to each other and that are connected at one end by the narrow side 24 that is positioned at a right angle to them. The other ends are connected to each other by an arc section 38 that extends about an angle range of 90°.

The longitudinal side 22 has the length 28 of 9 m. The oppositely positioned longitudinal side 25 has the length 28 of 13.5 m.

The narrow side 24 has the width 33 of 4.5 m.

The arc section 38 has the radius of curvature 29 of also 4.5 m. In accordance with the buildings 4, the annex 39 has stories that are congruently placed on top of each other.

Figure 22:
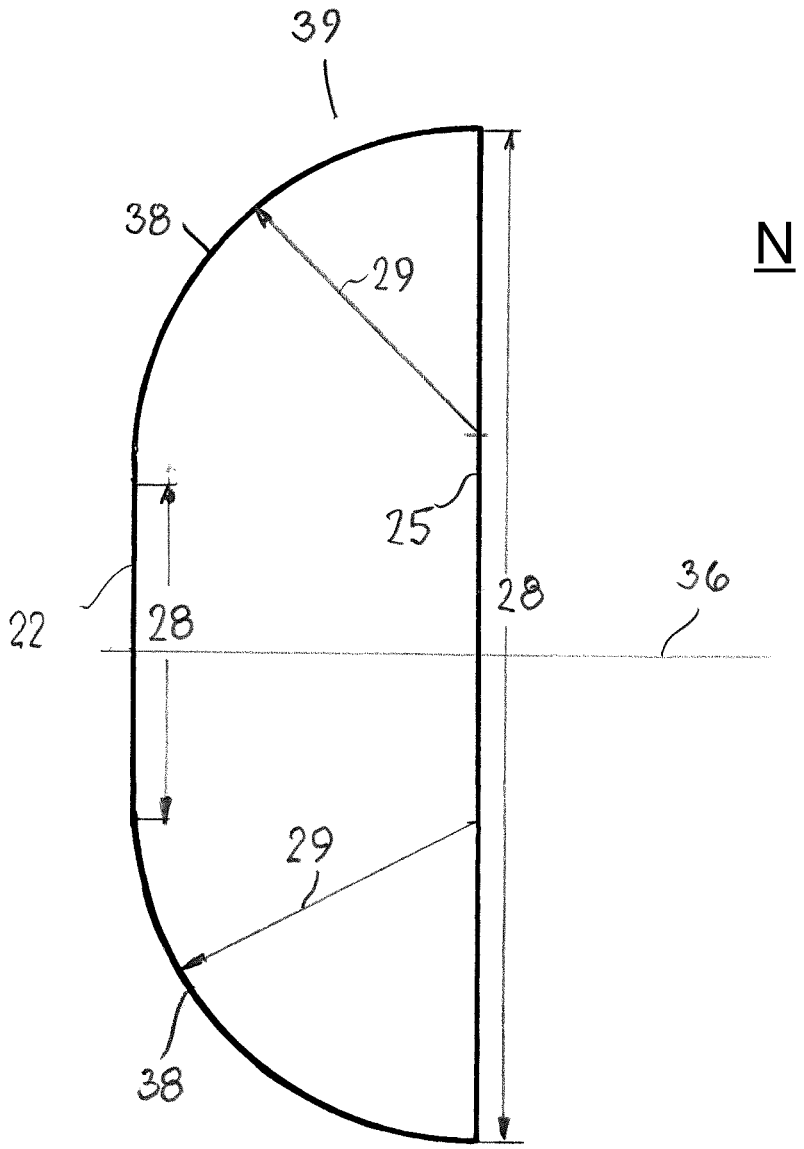
FIG. 22 shows another basic shape of a building in schematic illustration.

The annex 39 according to FIG. 22 has the basic shape N. It has the longitudinal side 25 with the length 28 of 13.5 m.

The longitudinal side 22 positioned oppositely and parallel thereto has the length 28 of 4.5 m and is centrally positioned in relation to the longitudinal side 25. The two longitudinal sides 22, 25 are connected to each other at both ends by the arc sections 38, respectively, which each are embodied curved about an angle range of 90° and each have a radius of curvature 29 of 4.5 m.

The contour of the basic shape N is mirror-symmetrical in relation to the straight line 36.

With the described basic shapes A through N of the buildings 4 and the annex 39, different houses can be constructed with a high variability. The individual basic shapes can be placed adjacent to each other and/or on top of each other in different building complexes. Since all basic shapes have a basic size in regard to width and/or length, the individual buildings and annexes can be placed adjacent to each other or on top of each other without problems and in a visually pleasing manner.

In the described embodiments, 4.5 m has been disclosed as a basic size (length, width, radius), respectively. This measure is however not to be understood as limiting. Any other suitable size, for example 3 m, 4 m, 5 m etc. can be used.

Figure 23:
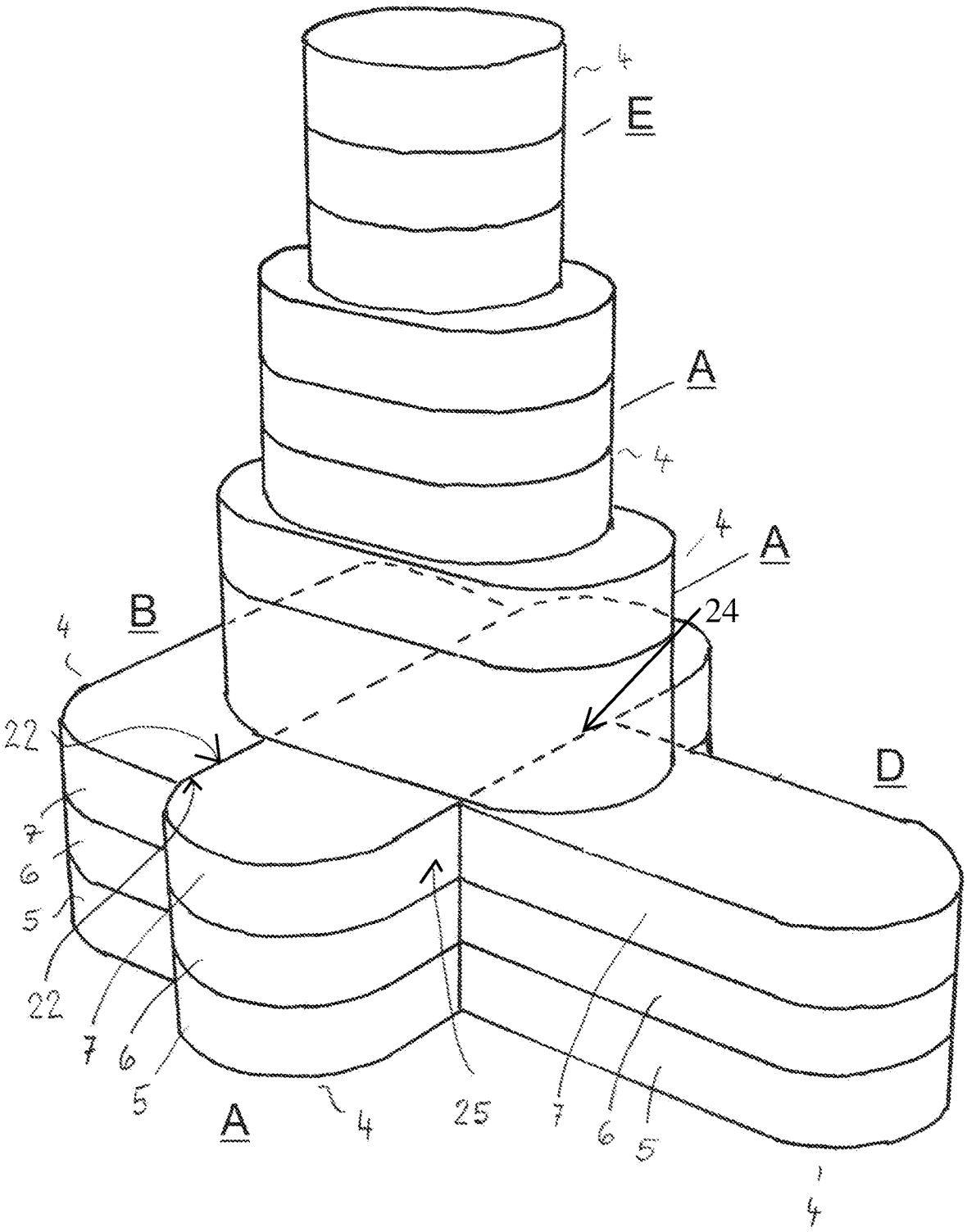
FIG. 23 shows a building complex according to the invention.
Figure 24:
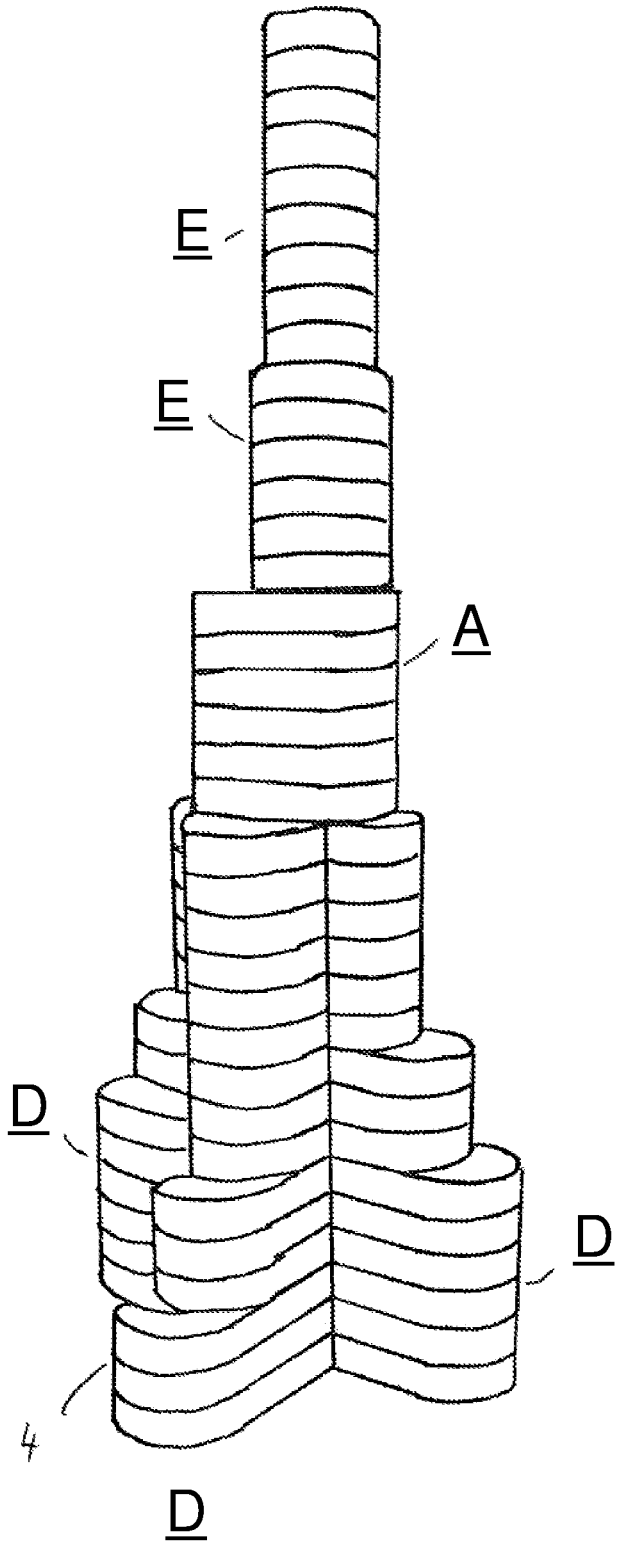
FIG. 24 shows another building complex according to the invention.
Figure 25:
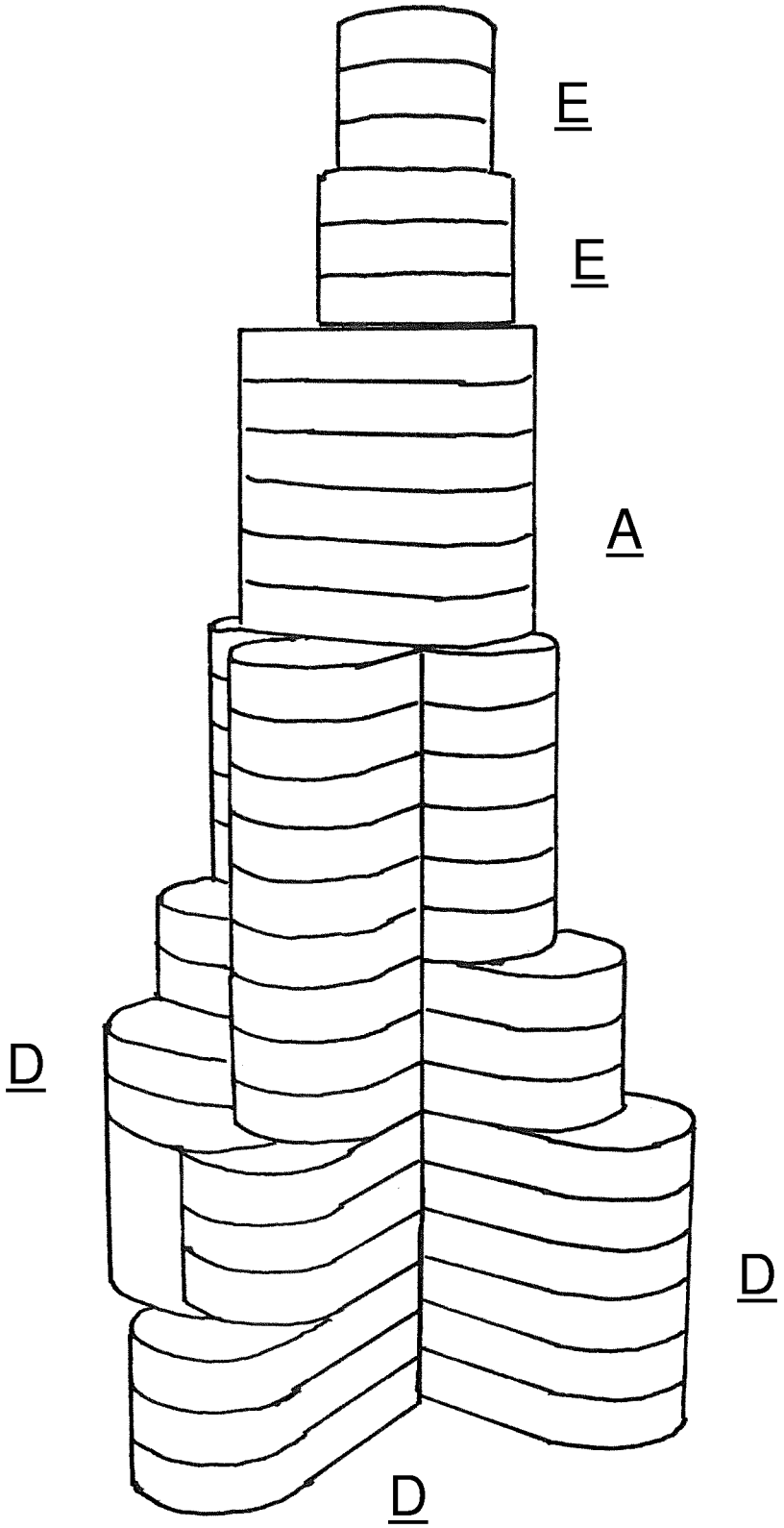
FIG. 25 shows yet another building complex according to the invention.
Figure 26:
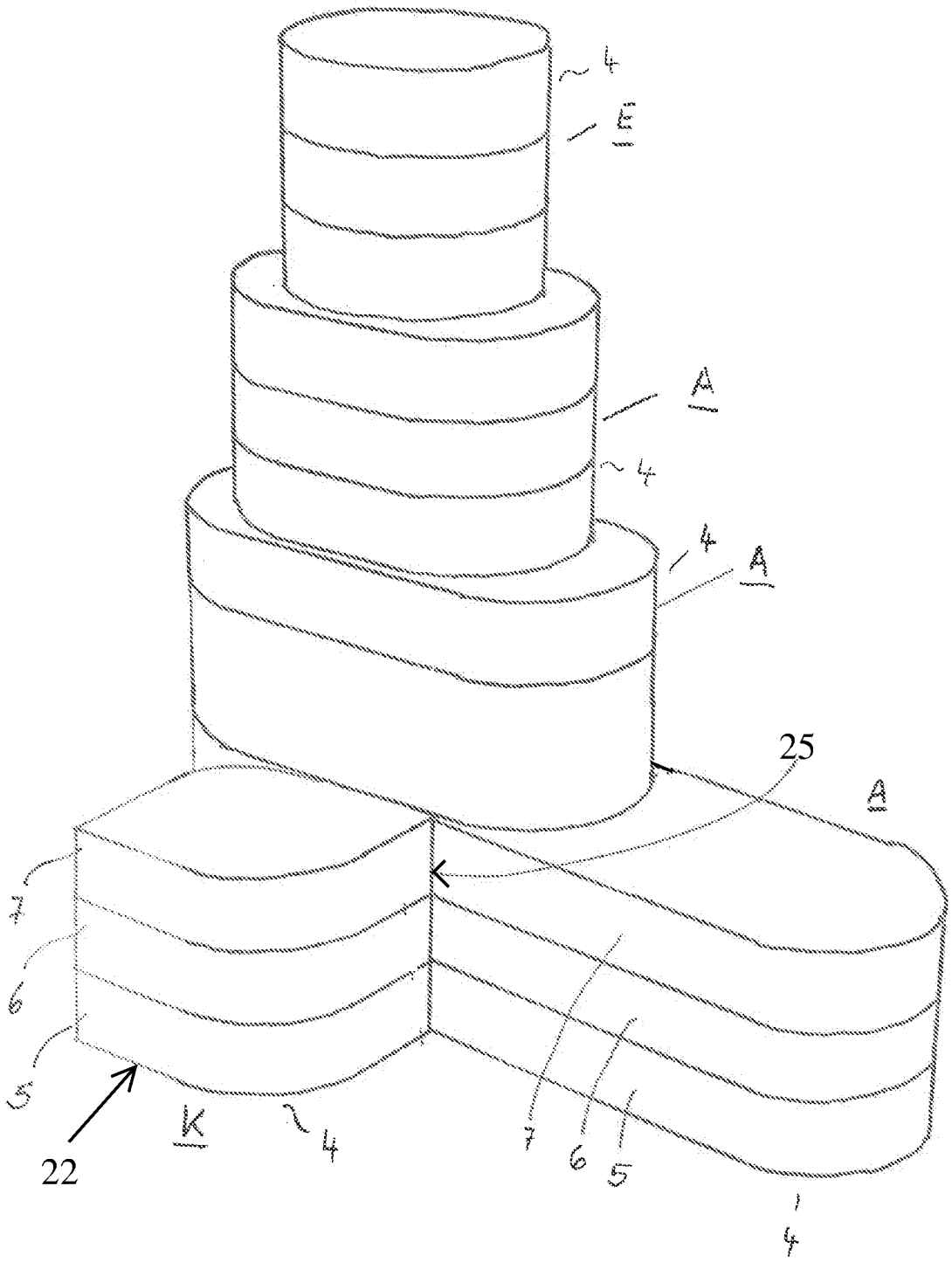
FIG. 26 shows a mirror-symmetrical building (K) with two narrow sides passing in an arc shape into two longitudinal sides, respectively, wherein the building (K) abuts a building complex with a longitudinal side thereof.
Figure 27:
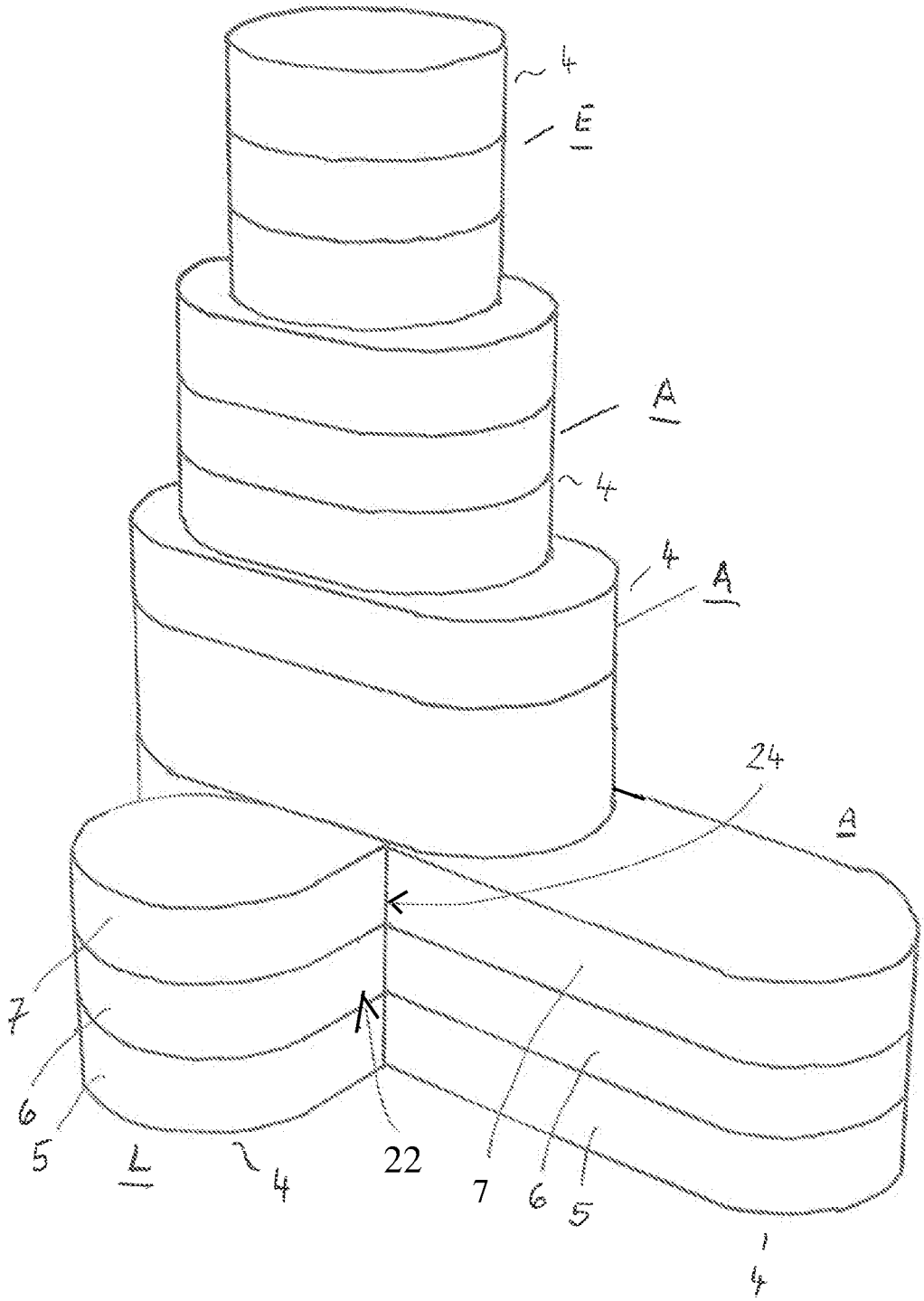
FIG. 27 shows a building (L) with a curved side extending about an angle range of 270 degrees, wherein the building (L) abuts a building complex with a longitudinal side thereof.

With the aid of FIGS. 23 to 25, in an exemplary fashion building complexes are illustrated which can be produced in a simple way with the differently designed basic shapes of the buildings.

The building illustrated in FIG. 23 is a high-rise building that can be erected with the different basic shapes in a simple way.

The lower region of the high-rise building has centrally the building 4 with the basic shape A. It has three stories 5 to 7.

A building 4 with the basic shape D adjoins the longitudinal side 25 of the basic shape A. The basic shape D is placed with its narrow side 24 next o the longitudinal side 25 of the basic shape A such that the basic shape D is positioned centrally in relation to the longitudinal side 25 of the basic shape A.

A building 4 with the basic shape B adjoins the oppositely positioned longitudinal side 22 of the basic shape A. It is positioned with its longitudinal side 22 at the longitudinal side 22 of the basic shape A.

The basic shapes B and D have also stories 5 to 7 that are congruently placed on top of each other.

Onto the basic shapes A, B, D, a basic shape A is placed such that, in plan view, it is positioned symmetrical to the lower three basic shapes A, B, D.

The length extension of the basic shape A corresponds thus to the length extension of the basic shape D.

As illustrated in FIG. 23, the building 4 with the basic shape A is also positioned perpendicularly to the building 4 of the basic shape A in the lower plane.

Onto the building 4 with the basic shape A in the second plane, a building 4 with the basic shape A is placed whose length and width dimensions are smaller than that of the building 4 in the second plane. The building 4 in the third plane is placed centrally onto the building 4 in the second plane.

The upper part of the residential complex is formed by the building 4 with the basic shape E. It is placed centrally onto the building 4 in the third plane.

FIG. 24 shows in schematic illustration in an exemplary fashion a further embodiment that is constructed as a high-rise building and is comprised of different buildings. For building the high-rise building, for example, buildings with the basic shapes A, D and E are used. In contrast to the preceding embodiment, the high-rise building has a significantly greater height. It can also be seen that, for example, same types of basic shapes can be positioned congruently on top of each other. Due to the basic size provided in all basic shapes, in the embodiment 4.5 m, the individual basic shapes can be positioned arbitrarily on top of each other such that the basic shapes that are placed adjacent or on top of each other contact each with precise fit. In this way, for example, the building 4 with the basic shape D (FIG. 13*d*) with its narrow side 24 can be placed against the longitudinal side 25 of the building 4 with the basic shape A.

In the same manner, for example, the basic shapes B and C (FIGS. 13*b* and 13*c*) can be placed against each other with their longitudinal sides 22.

As a further example, the basic shape E can be considered which has a diameter of 9 m. It can be positioned, for example, onto the building 4 with the basic shape H (FIG. 16). Since the basic shape H has the width 31 of 9 m, the building 4 with the basic shape E does not project past the sides of the basic shape H.

In particular with the basic shapes K and L, building complexes can be combined that are characterized by an unusual and striking design. For example, several basic shapes K can be placed next each other such that the longitudinal side 22 of a basic shape K contacts the longitudinal side 25 of the neighboring basic shape K. In this way, several buildings 4 with the basic shape K can be placed next to each other.

Figure 28:
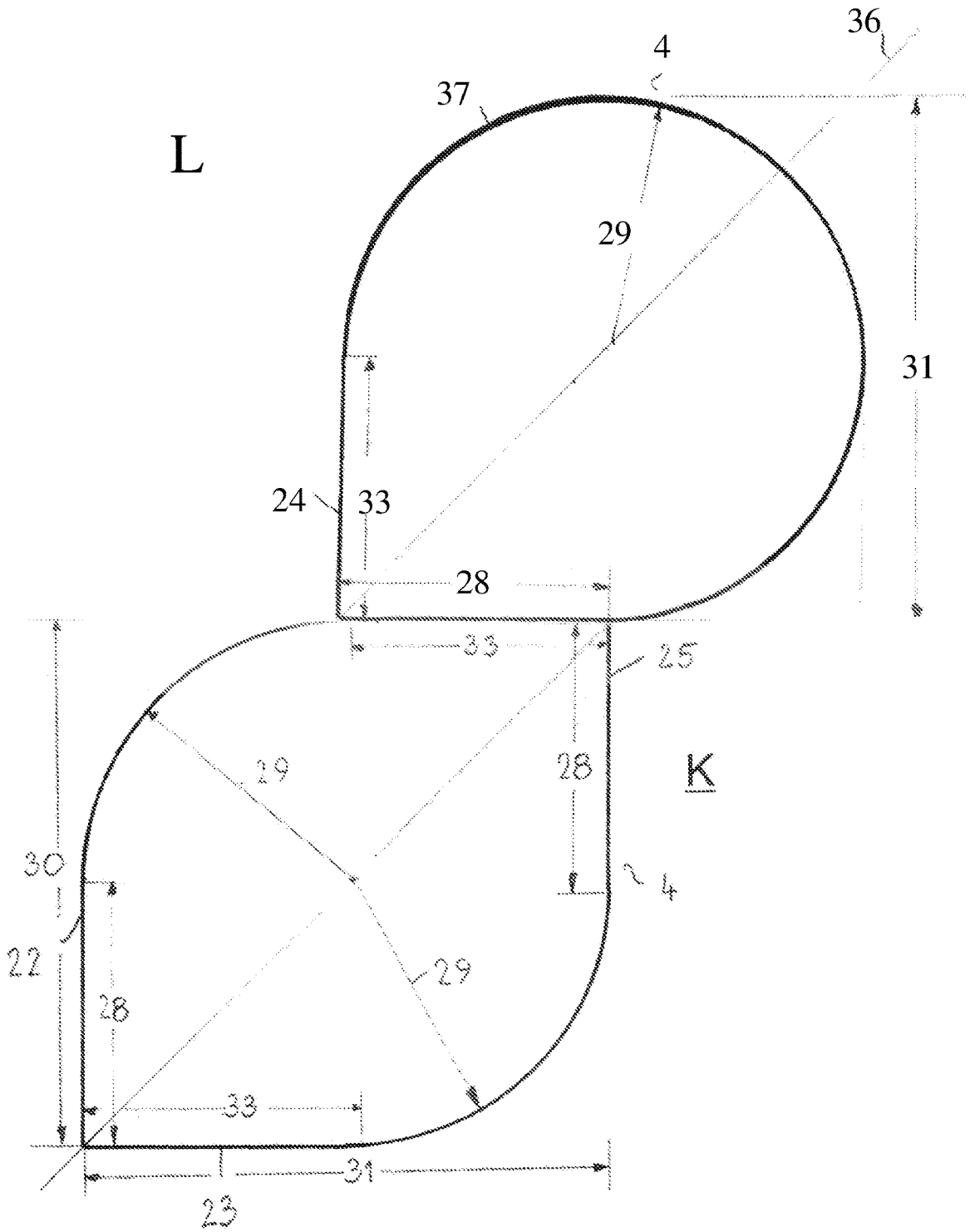
FIG. 28 shows a building (K) and a building (L) abutting each other.

Also, the basic shapes K and L can be joined in any combination to each other (see e.g. FIG. 28). For example, the basic shape L with its longitudinal side 22 adjoins the same longitudinal side 22 or 25 of the same length of the neighboring building 4 with the basic shape K.

These, only exemplary, variation possibilities demonstrate that due to the same basic size of all basic shapes it is very simple to erect, depending on the design task, buildings that can be optimally adapted to the intended case of use.

FIG. 25 shows a further possibility as to how the buildings of different basic shapes cannot only be positioned adjacent to each other but also placed on top of each other. The selection of the basic shapes is only dependent on which design the high-rise building is to have.

The described and illustrated buildings or building complexes are to be understood only as examples and are provided to demonstrate how differently designed buildings can be erected in a very simple manner from the variously designed buildings 4.

The specification incorporates by reference the entire disclosure of prior filed German application for patent No. 10 2020 001 012.1 having a filing date of Feb. 14, 2020.

While specific embodiments of the invention have been shown and described in detail to illustrate the inventive principles, it will be understood that the invention may be embodied otherwise without departing from such principles.

What is claimed is:

1. A building complex comprising a plurality of buildings, wherein each building comprises at least two congruent stories, wherein each building comprises a basic size, respectively, in a width direction and in a length direction, wherein a length in the length direction and a width in the width direction correspond to said basic size or to a multiple of said basic size, respectively, wherein the plurality of buildings include a first building and a second building, wherein the first building is arranged on top of the second building, wherein the first building has a smaller cross section area than the second building;

wherein the plurality of buildings include three ground buildings, wherein the three ground buildings include a center building, a first neighboring building, and a second neighboring building, wherein the center building comprises a first longitudinal side and a second longitudinal side extending parallel to each other and passing into each other by semicircular sidewalls, wherein the first neighboring building comprises a longitudinal side abutting the first longitudinal side of the center building, wherein the second neighboring building comprises a narrow side abutting the second longitudinal side of the center building, and wherein the second longitudinal side of the center building is longer than the narrow side of the second neighboring building.

2. A building complex comprising a plurality of buildings, wherein each building comprises at least two congruent stories, wherein each building comprises a basic size, respectively, in a width direction and in a length direction, wherein a length in the length direction and a width in the width direction correspond to said basic size or to a multiple of said basic size, respectively, wherein the plurality of buildings include a first building and one or more second buildings, wherein the first building comprises two longitudinal sides extending parallel to each other but displaced relative to each other in the length direction, wherein the first building comprises two narrow sides extending parallel to each other but displaced relative to each other in the width direction, wherein the two narrow sides each have a first end adjoining at a right angle a first end of the two longitudinal sides, respectively, and defining opposed corners, wherein the two narrow sides each have a second end passing in an arc shape into a second end of the two longitudinal sides, respectively, so that the first building is mirror-symmetrical in relation to a line extending through the opposed corners, wherein the first building abuts the one or more second buildings with one or both of the two longitudinal sides.

3. A building complex comprising a plurality of buildings, wherein each building comprises at least two congruent stories, wherein each building comprises a basic size, respectively, in a width direction and in a length direction, wherein a length in the length direction and a width in the width direction correspond to said basic size or to a multiple of said basic size, respectively, wherein the plurality of buildings include a first building and one or more second buildings, wherein the first building comprises a narrow side extending in the width direction and a longitudinal side extending in the length direction and adjoining the narrow side at a right angle to define a corner, wherein an end of the longitudinal side opposite the corner and an end of the narrow side opposite the corner are connected to each other by a uniformly curved side extending about an angle range of 270° to form a tear shape, wherein the first building abuts the one or more second buildings with the longitudinal side and/or the narrow side.

4. A building complex comprising a plurality of buildings, wherein each building comprises at least two congruent stories, wherein each building comprises a basic size, respectively, in a width direction and in a length direction, wherein a length in the length direction and a width in the width direction correspond to said basic size or to a multiple of said basic size, respectively, wherein the plurality of buildings include a first building and one or more second buildings, wherein the first building comprises a narrow side extending in the width direction and a longitudinal side extending in the length direction and adjoining the narrow side at a right angle to define a corner, wherein an end of the longitudinal side opposite the corner and an end of the narrow side opposite the corner are connected to each other by a uniformly curved side extending about an angle range of 270°, wherein the first building abuts the one or more second buildings with the longitudinal side and/or the narrow side;

wherein the one or more second buildings each comprise two longitudinal sides, extending parallel to each other but displaced relative to each other in the length direction, and two narrow sides, extending parallel to each other but displaced relative to each other in the width direction, wherein the two narrow sides of the respective second building each have a first end adjoining at a right angle a first end of the two longitudinal sides of the respective second building, respectively, and defining opposed corners, wherein the two narrow sides of the respective second building each have a second end passing in an arc shape into a second end of the two longitudinal sides of the respective second building, respectively, so that the respective second building is mirror-symmetrical in relation to a line extending through the opposed corners.

5. The building complex according to claim 4, wherein the first building is tear-shaped.

* * * * *